US010557485B2

(12) United States Patent
Mankau

(10) Patent No.: US 10,557,485 B2
(45) Date of Patent: Feb. 11, 2020

(54) ACTUATOR

(71) Applicant: Festo AG & Co. KG, Esslingen (DE)

(72) Inventor: Dieter Mankau, Frankfurt am Main (DE)

(73) Assignee: Festo AG & Co. KG, Esslingen (DE)

( * ) Notice: Subject to any disclaimer, the term of this patent is extended or adjusted under 35 U.S.C. 154(b) by 18 days.

(21) Appl. No.: 15/563,616

(22) PCT Filed: Apr. 4, 2016

(86) PCT No.: PCT/EP2016/057362
§ 371 (c)(1),
(2) Date: Oct. 2, 2017

(87) PCT Pub. No.: WO2016/156618
PCT Pub. Date: Oct. 6, 2016

(65) Prior Publication Data

US 2018/0087545 A1 Mar. 29, 2018

(30) Foreign Application Priority Data

Apr. 2, 2015 (DE) ..... 10 2015 004 181

(51) Int. Cl.
*F15B 15/10* (2006.01)

(52) U.S. Cl.
CPC ..... *F15B 15/103* (2013.01); *F15B 15/10* (2013.01)

(58) Field of Classification Search
CPC ..... F15B 15/103
USPC ..... 92/92
See application file for complete search history.

(56) References Cited

U.S. PATENT DOCUMENTS 4,976,191 A * 12/1990 Suzumori ..... B23Q 1/34 92/103 R
5,203,319 A 4/1993 Danna et al.
5,251,538 A * 10/1993 Smith ..... F16J 3/06 92/34

(Continued)

FOREIGN PATENT DOCUMENTS

DE 102012004150 8/2013
DE 102012006564 8/2013
EP 1865208 12/2007

(Continued)

OTHER PUBLICATIONS

International Preliminary Report on Patentability dated Oct. 12, 2017 From the International Bureau of WIPO Re. Application No. PCT/EP2016/057362. (17 Pages).

(Continued)

*Primary Examiner* — Michael Leslie

(57) ABSTRACT

A control element (1310) has at least one elastic internal part (1332) that can be connected, via a connection, to a pressurized fluid source and/or a vacuum source, which permits pressurization or evacuation of a cavity in the internal part (1332). In order to provide a control member for general use, it is proposed that the elasticity module of a wall (1328) bounding the internal part (1332) is formed differently in certain sections such that, instead of a homogeneous increase or decrease in volume under pressurization or evacuation, an oriented change in shape takes place, between a resting state and a pressurized or evacuated state, that describes a control path of the control element (1310).

28 Claims, 29 Drawing Sheets

(56) References Cited

U.S. PATENT DOCUMENTS

| | | | | |
|---|---|---|---|---|
| 9,492,930 | B2 * | 11/2016 | Galloway | B25J 15/0023 |
| 2015/0040753 | A1 * | 2/2015 | Bishop-Moser | F15B 15/10 92/254 |

FOREIGN PATENT DOCUMENTS

| | | |
|---|---|---|
| FR | 993432 | 10/1951 |
| JP | 63-120791 | 8/1988 |
| JP | 02-113104 | 4/1990 |
| JP | 04-165110 | 6/1992 |
| JP | 06-094008 | 4/1994 |

OTHER PUBLICATIONS

Internationaler Recherchenbericht and Schriftlicher Bescheid [International Search Report and the Written Opinion] dated Jul. 22, 2016 From the International Searching Authority Re. Application No. PCT/EP2016/057362 and Its Translation of Search Report Into English. (15 Pages).

* cited by examiner 14, 24
18
10
12

14, 24
34
10
12

14
16
30
10
12

24
26
28
30
10
12

362
362
324
332
340
360

362
360

340
334
324
130
334
340

332

534
518
534
518
512

518
534
518
534
511

518
540
516
534
510

Fig. 54
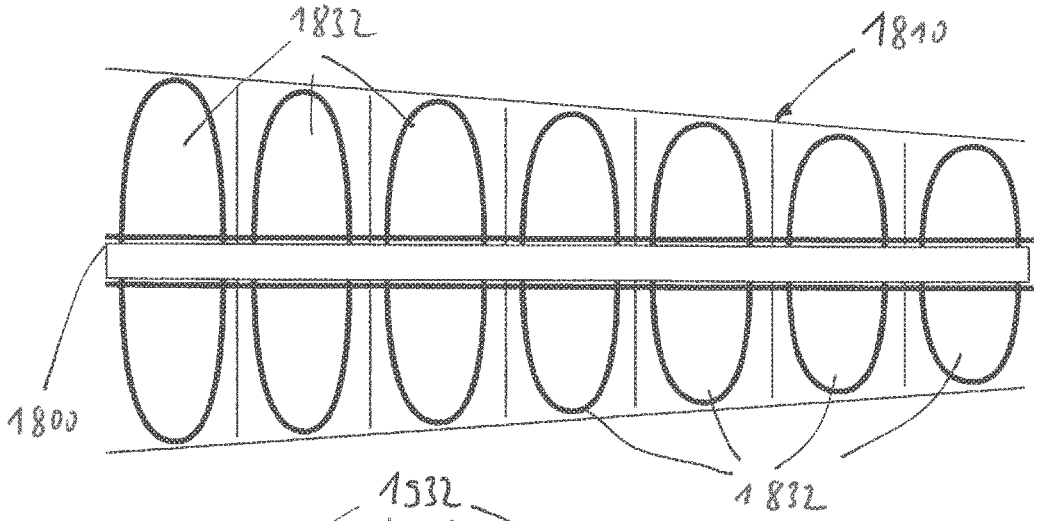
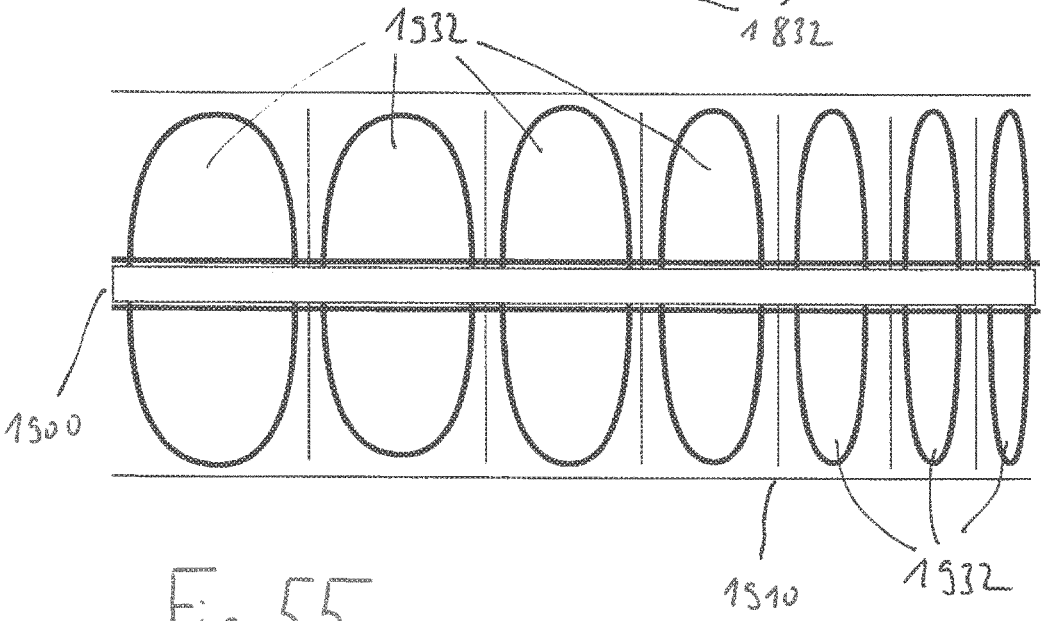
Fig. 55

ACTUATOR

RELATED APPLICATIONS

This application is a National Phase of PCT Patent Application No. PCT/EP2016/057362 having International filing date of Apr. 4, 2016, which claims the benefit of priority of German Patent Application No. 10 2015 004 181.9 filed on Apr. 2, 2015. The contents of the above applications are all incorporated by reference as if fully set forth herein in their entirety.

FIELD AND BACKGROUND OF THE INVENTION

The present invention relates to a control element or actuator with at least one elastic expansion element as an internal part that can be connected, via an attachment, to a pressurized fluid source and/or a vacuum source, which permits pressurization or evacuation of a cavity in the expansion element.

Control elements of this kind are used in a wide variety of fields. For example, pneumatic actuators are used in automation technology or also for other fields in which a control function is intended to be performed by activation of such a control element in response to a control signal that is triggered manually or automatically.

Besides the known control elements, which generally work according to the cylinder/piston principle, the document EP 1 865 208 A2 has also already disclosed a deflection element in which a cushion acts on a predefined support structure and deflects the latter in a specific manner under pressurization. The support structure is generally a joint structure, at the desired deflection sites of which one or more cushions are arranged in order to effect the desired change of shape of the support structure. A disadvantage of such a solution is that, for each application, a special support structure has to be provided on which differently configured cushions then have to be arranged in order to produce the functional safety. This entails considerable production outlay, since the flexible supports and the cushions each have to be constructed for the particular purpose and linked to each other. The object of the present invention is to make available a control element that can be used universally.

SUMMARY OF THE INVENTION

According to the invention, the object is achieved by the fact that, in a control element of the kind mentioned at the outset, the modulus of elasticity of the wall of the expansion element is formed differently in certain sections such that, instead of a homogeneous increase in volume under pressurization or evacuation, a directed change of shape takes place, between the resting state and a pressurized or evacuated state, that describes a control path of the control element between a resting position and a functional position.

The advantage of the solution according to the invention is that, in contrast to the solution discussed above, the control elements no longer have to be integrated into a respective mechanism and adapted, and instead a control element is made available by simple means and can be used similarly to the known pneumatic control cylinders. Similarly, such a control element can of course also be adapted to a specific purpose. In a first preferred embodiment of the invention, provision can be made that the modulus of elasticity of a tubular expansion element is high in the radial direction, in such a way that the change of shape under pressurization occurs in the longitudinal direction of the tube shape and/or in a bending direction of the tube shape. Such stiffening can be achieved, for example, by annular elements/annular anchors which can already be coupled to each other in the axial direction, such that a targeted deflection of the tubular control element occurs under pressurization or evacuation. If elastic walls are provided between the annular elements stiffening the radial direction, this results in a purely axial extension of the control element, such that a function similar to a pneumatic control cylinder is obtained.

Control movements in opposite directions can be achieved by at least two internal parts which act in opposite directions and which act about a central position. However, the central position can also be given in the resting state, wherein pressurization of one internal part effects the control movement in the one direction relative to the central position, and application of a vacuum or at least an underpressure to the same internal part effects a control movement in the other direction.

The control element is preferably designed such that an elastic material of the at least one expansion element as elastic internal part forms, with a stiffer material of a structural element, a composite as a wall, wherein punctiform, linear or planar connection sites are provided. The structural element increases the modulus of elasticity of the otherwise homogeneously elastic sheath of the expansion element in certain sections, such that the desired change of shape takes place under pressurization. Otherwise, the structural element limits the expansion capacity of the internal part or expansion element, which can be designed as a thin-walled tube, in all other degrees of freedom that cannot contribute to the control movement. This prevents the occurrence of excessive local changes of volume or prevents a situation where the optionally very thin-walled expansion element can bulge out locally or even be hyperextended. The stiffening can be for the purpose of an only slight increase of the modulus of elasticity. However, for pronounced articulated control movements of the control element, stiffenings are also possible which do not permit an elastic change of shape at these locations.

Typical elastic materials for all of the embodiments described here are natural rubber, silicone rubber, plastics or the like.

A composite of this kind for forming the wall with a directed modulus of elasticity is expedient from the point of view of production technology and prevents an uncontrolled deformation of the expansion element deviating from the deformations permitted by the structural element. The structural element can, among other things, also be directly embedded in the elastic material of the expansion element or arranged inside this, or it can also engage over this in the manner of a sheath. Welded or adhesively bonded connections are possible at the connection sites. However, it may also be expedient to design the connection sites as loose bearing points, such that a pushing movement between the structural element and the expansion element is permitted during the change of shape.

Embodiments are particularly preferred in which the wall has one stiffened zone, or generally a plurality of stiffening zones, engaging annularly around the internal part and acting as annular element or annular anchor.

These zones, which can be designed as tension-resistant annular elements accordingly adapted to the cross-sectional shape of the internal part, prevent an increase in volume in the direction which in most cases makes no contribution to the execution of a targeted control movement.

In order to protect the expansion element against uncontrolled deformation when pressurized, it may be expedient that the structural element surrounds the at least one expansion element completely or like a cage.

Any kind of inlay or covering is suitable in principle as the structural element, particular note being made here to woven fabrics, sintered bodies of plastic, or plastic layers injected around the expansion element or produced by blow molding, which can also form the structural element in combination with each other. An example of a kind of woven fabric which, in the composite with the wall of the expansion element, can ensure the function according to the invention is known from DE 10 2012 004 150 A1. The meshware described therein, which is expressly intended to be included under the term woven fabric, ensures that certain zones of this woven fabric have a different force-elongation behavior. While the meshware described there is conceived as a medical aid or sports aid for avoiding uncontrolled movements in order to protect the joints or the muscles, it is possible, in a further development of the corresponding meshware within the meaning of the present invention, to adjust the desired kinematics of a control element by means of a corresponding meshware being coupled to the wall of an elastic expansion element of the control element or being embedded in the wall.

In particular for application of higher forces, it is also possible to use sintered bodies of plastic as structural element, or a plastic layer which is formed directly around the expansion element and which, for example in a multi-component injection molding technique with the expansion element, a dipping process or blow molding process, can be produced jointly with the expansion element or subsequently. Sintered plastic parts, as parts produced in additive production processes, afford the possibility of adapting complex joint structures to the contours of the expansion element. Some of these additive production processes can be carried out on what are called 3D printers.

A common aspect of all the variants is that the structural element and the at least one expansion element follow substantially the same basic shape, i.e. the structural element does not form a support structure extending substantially beyond the at least one expansion element, as this would be contrary to the aim of the invention which is to make available a control element that can be used universally.

In order to avoid an uncontrolled deflection of the control element at a higher pressure level, end abutments are preferably provided which limit the change of shape at a defined pressure level. The end abutments ensure that the modulus of elasticity of the wall of the expansion element is not substantially increased during the control movement, but a further change of shape is blocked when a desired end position is reached, i.e. the modulus of elasticity is greatly increased starting from this state. The end abutments can be adjustable, e.g. also by an electrical actuator.

If appropriate, a viscoelastic material that damps oscillations can be incorporated into the structural element and/or into the expansion element. This kind of damping of oscillations may be desirable particularly in the case of control elements that are subject to strong dynamic stress.

Depending on the field of use of such a control element, relatively large cavities may be needed in the at least one expansion element in order to ensure the desired control forces or movements. To avoid conveying a large volume of pressurized fluid, it may in some cases be expedient that the cavity of the at least one expansion element is partially filled by rigid volume bodies. Rigid signifies that the corresponding bodies do not change their volume under pressurization, although they do not of course prevent the control movement of the control element.

In another embodiment, elastic shaped bodies can be arranged in the cavities and stabilize the shape of the internal part in a resting state. Shaped bodies of this kind can be, for example, brush-like elements or foamed bodies which are loose or are connected to the structural element, but the cavity can also simply be filled with foam. In the case of shaped bodies connected to the structural element, these can limit, for example like threads, the maximum spacing of a double wall.

Correspondingly, free spaces that are present between the at least one expansion element/internal part and the structural element can also be at least partially filled by corresponding rigid bodies, foam bodies or brush-like elements. Here too, the free spaces can subsequently be filled with foam.

The shaped bodies can also have the viscoelastic properties already discussed in principle.

As has already been mentioned, it may be expedient to stiffen the wall of the expansion element in certain sections, in such a way that there is no longer any elastic behavior there. This can in itself permit joint-like control movements of the control element or can also ensure an end abutment in the area of inherently elastically deformable wall parts. Such tension-resistant elements can be designed as cables, bands, rods or woven or latticed structures made of metal or plastic.

In many embodiments, the structural element preferably has a rigid clamping point for securing on a support structure. A clamping point of this kind in the manner of an assembly flange may be expedient for binding the control element to an installation where it then executes its defined control movement under pressurization. Clamping points at both ends may be expedient for coupling a plurality of control elements.

As has already been indicated, the control element according to the invention can be designed with a plurality of expansion elements, as a result of which, on the one hand, the control paths can be increased and, on the other hand, control movements can also be effected in different directions by means of a single control element. For example, in order to increase an axial control path, it is possible to provide a plurality of expansion elements which are arranged axially behind one another and interconnected and whose cavities are spatially separated from each other and have separate pressurized fluid attachments. The axial deformabilities under pressurization of the individual expansion elements then add up to a maximum overall control path or permit the targeting of intermediate states. Rigid clamping surfaces are preferably formed between the expansion elements, in particular if the targeting of intermediate positions on the control path is desired.

However, by means of a plurality of expansion elements, a movement of the control element in different directions is also possible if, according to a preferred embodiment, the control element has a tube shape which is subdivided about the circumference and/or radially into a plurality of expansion elements whose cavities are separated from each other and which have separate pressure attachments. Depending on the pressurization of the expansion elements, a finger-like control element of this kind can be bent not only in one direction but practically in any desired direction, such that its field of use is correspondingly extended.

An embodiment of a control element can also be particularly preferable in which the structural elements are composed of a sequence of mutually articulated members as modules, between which the internal parts are arranged. The cavities of the internal parts succeeding one another in the longitudinal direction of the control element can be connected to each other via pressure lines, preferably via pressurized fluid couplings, which permit a variable juxtaposition of modules since the structural elements are connected mechanically and the internal parts are connected for flow of pressurized fluid.

Preferably, at least two internal parts that can be pressurized separately from each other are arranged in the area of a module about the circumference. In the case of two such internal parts, a bending movement takes place in one plane, while three or more internal parts permit a bending movement in space. The corresponding degrees of freedom are preferably afforded by the articulated connections between the modules, which connections are formed by ball joints, joint axles or quasi joint-like, flexurally elastic connections. In a spatial bending movement, a cardan joint with two joint axles arranged at an angle to each other may be advantageous.

In a special embodiment taking account of the fact that the moment that has to be applied is mostly smaller at a greater distance from the clamping point of the control element, provision is made that the volumes, lengths or diameters of the successive internal parts or structural elements or modules in the longitudinal direction of the control element are different and preferably increase or decrease continuously.

In order to avoid the expansion elements influencing each other in an uncontrolled manner, provision is made that tension-resistant walls are in each case formed between them.

The tension-resistant walls of this embodiment are preferably incorporated into a member structure which permits a bending of the control element in the desired one or more bending directions, but which at the same time suppresses an axial extension of the control element. In such a case, the member structure as part of the structural element is not arranged like a sheath around the expansion element but instead integrated into the control element between the expansion elements. This may also be the case in a modular configuration.

In a further preferred embodiment of a structural element, provision is made that the latter at least partially surrounds the at least one elastic expansion element like a bellows. A bellows structure, which can be designed for example as a corrugated tube made of metal or plastic, as a woven structure or as a plastic or rubber bellows, has the advantage that it does not in practice increase the coefficient of elasticity within the permitted tension range but, after stretching of the folds, abruptly increases the modulus of elasticity in the sense of an end abutment and thus limits a further expansion. In a bellows-like structural element of this kind, some or all of the folds or corrugations of the bellows-like structural element that are directed toward the expansion element are preferably connected to the expansion element or are designed as loose bearing points. Buffer elements, which can be ring-shaped in the case of a tubular control element, can be arranged in the area of the bearing points in order to avoid a direct contact between the expansion element and the bellows-like structural element. The bellows-like structural elements can also be provided centrally in order, for example, to shield a channel which is provided for cables or lines and which is preferably formed where the smallest path differences occur upon actuation of the control element.

In a preferred embodiment of the invention, electrical attachment lines or pressurized fluid lines are arranged precisely in these stiff areas of the control element or areas that are deformable exclusively in the bending direction. While it may sometimes be sufficient, in the case of finger-like control elements, to provide the corresponding attachments in the area of the rigid clamping point, from which a connection to the cavities of the expansion elements can directly exist, it is expedient, particularly in the case of control elements with a plurality of expansion elements arranged axially one behind another, to provide such areas in order not to unnecessarily load the attachment lines. Electrical attachment lines can be provided, for example, if further electrical actuators are arranged on the control element itself, for example magnetic grippers, or if deformable wall portions of the at least one expansion element/internal part are provided with measurement elements in the form of expansion measurement elements or optical measurement elements by means of which an exact detection of the actual change of shape of the control element under pressurization is permitted. In this way, despite the inherently elastic nature of the expansion element, the changes of shape of the control element can be detected precisely.

It is particularly advantageous to use a shape sensor in which the measurement element consists of a conductor foil arranged helically in the longitudinal direction of the control element.

On the gripping surfaces, it may be expedient to provide a slip-resistant material or a structure that counteracts slipping, for example of a detected load. However, as has already been mentioned, electromagnetic grippers with which material can be picked up and set down can also be provided in the area of the gripping surfaces.

BRIEF DESCRIPTION OF THE SEVERAL VIEWS OF THE DRAWINGS

Illustrative embodiments of the invention are explained in more detail below with reference to the attached drawings, in which:

FIG. 54 shows a schematic longitudinal section of a control element with internal parts that vary lengthwise;

FIG. 55 shows a schematic longitudinal section of a further embodiment of a control element with internal parts that vary lengthwise.

DESCRIPTION OF SPECIFIC EMBODIMENTS OF THE INVENTION

Figures 1, 2, 3, 4:
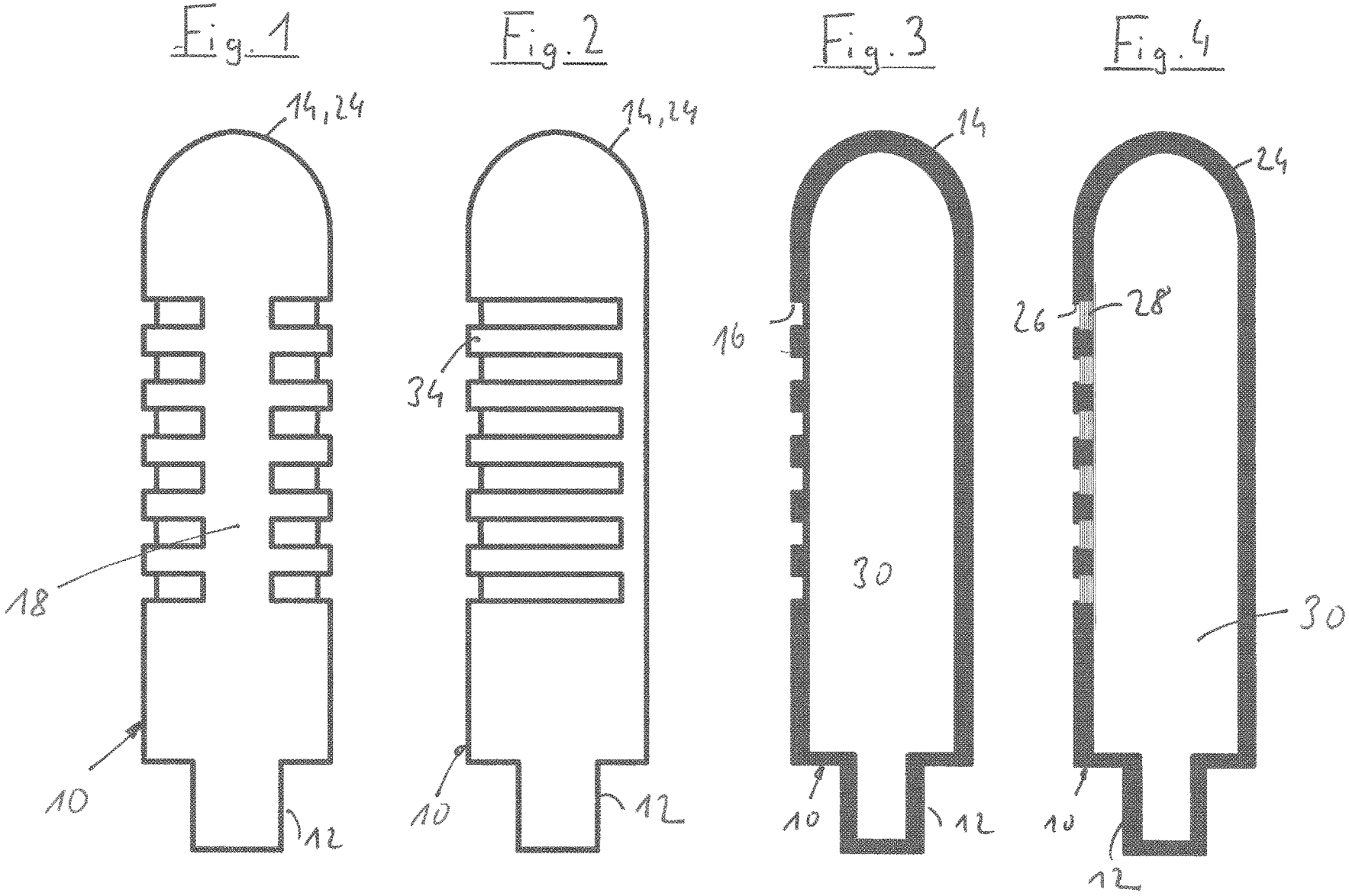
FIG. 1 shows a view of a finger-shaped control element.
FIG. 2 shows a view of the control element from FIG. 1 rotated through 90°.
FIGS. 3, 4 and 5 show longitudinal sections of various embodiments of a control element according to FIG. 1.
Figure 6:
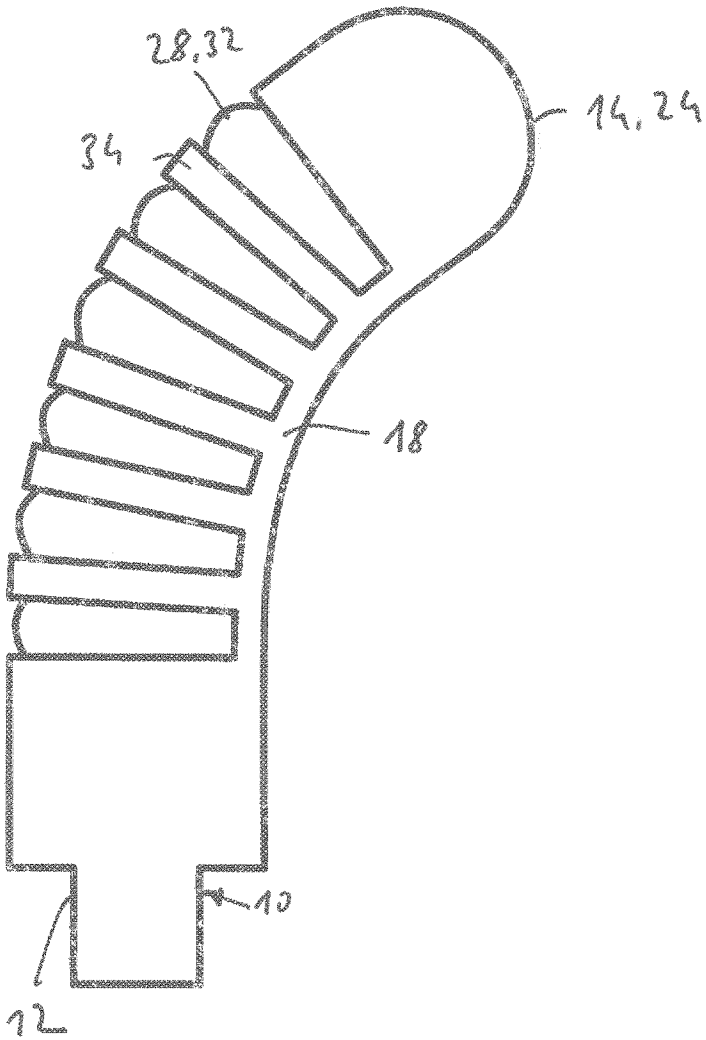
FIG. 6 shows a side view of the control element in the deflected state.

FIG. 1 shows a view of a finger-shaped control element 10 which, when pressurized, can be deflected from a straight resting position shown in FIGS. 1 and 2 to the bent position shown in FIG. 6. The bending movement can be utilized in order to grip and hold objects or to execute a control movement.

The control element 10 has a clamping point 12, which is secured on a stationary structure. To achieve the desired behavior, various constructions are possible. In a first embodiment, according to FIG. 3, provision is made that the control element 10 consists overall of a wall element 14 as an internal part made of an elastic material which, in a central area corresponding to FIGS. 1 and 2, is weakened by annular grooves 16, whereas on one side a web 18 in the form of a backbone remains, which is resistant to tension. When pressure is applied, the volume of the interior 30 of the internal part 14 increases as a whole, but in particular with expansion in the area of the grooves 16, since the elastic material is weakened there. An entirely similar effect can be obtained by a wall element 24 according to FIG. 4, which wall element 24 is itself made of a rigid plastic, but the latter nonetheless has a certain elastic deformability. In the area of the grooves 26, in a two-component technique, an elastic material 28 is provided which extends when pressure is applied to the interior 30, wherein the web 18 is subjected to an elastic bending deformation.

Figure 5:
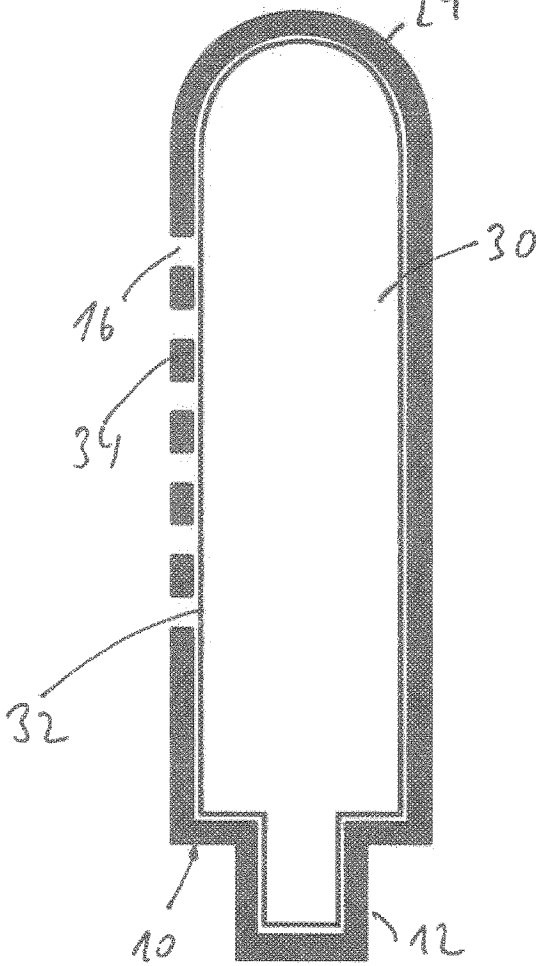

An embodiment which is simpler in terms of production, and less critical from the point of view of fatigue strength, is shown in FIG. 5, in which a wall element is provided as per the embodiment according to FIG. 4, but in which open slits are provided in the area of the grooves 36, wherein the pressure tightness of a cavity 30 is here achieved by an elastic, tubular internal part 32, to which the pressure can be applied. The annular webs 34 remaining between the grooves 26 prevent the tubular internal part 32, when pressurized, from experiencing too great a change of volume in the radial direction, such that, when pressure is applied, the increase in volume, as in the other embodiments too, leads to the deflection position shown in FIG. 6. The wall element thus influences the coefficient of elasticity of the wall of the internal part 32.

Figure 9:
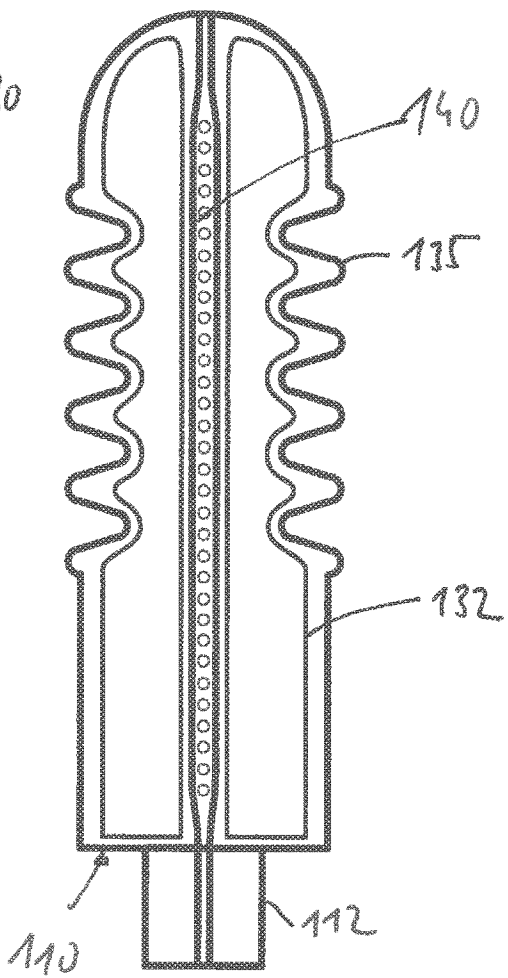
FIG. 9 shows a cross section of the control element from FIG. 8 rotated through 90°.
Figure 8:
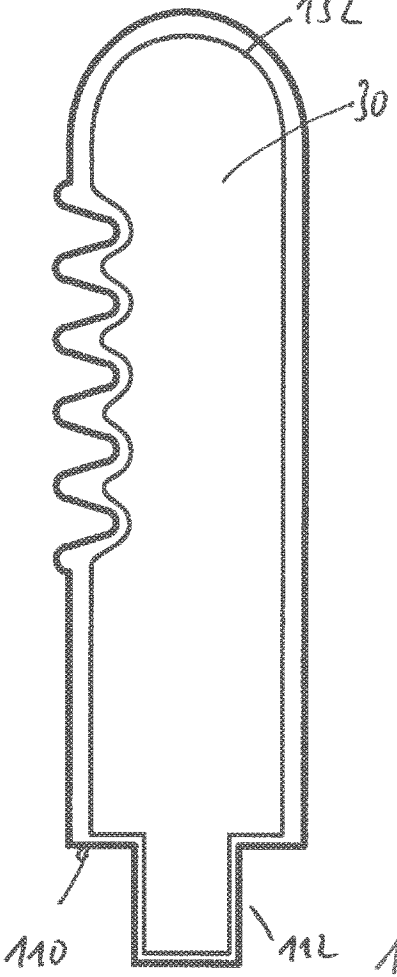
FIG. 8 shows a longitudinal section of the control element according to FIG. 7.
Figure 7:
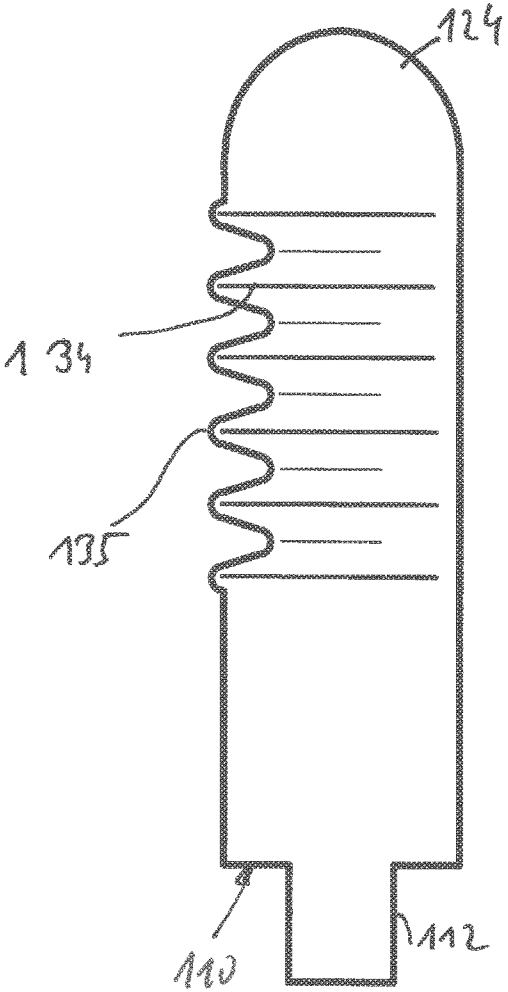
FIG. 7 shows a side view of a further embodiment of a finger-shaped control element.

FIGS. 7 to 9 show a further embodiment of a finger-shaped control element 110 which, in principle, can execute the same control movement and the above-described control element 10. This control element 110 also once again has a stiff clamping point 112 and an outer structural element 124, while a tubular elastic internal part 132 is once again provided on the inside. The structural element 124 is designed in some sections in the manner of a bellows 125 which in principle is elastic in the longitudinal direction but whose radial deformability is again limited by annular stiffenings 134. As can be seen from the rotated view in FIG. 9, a tension-resistant but flexurally elastic tension element 140 is provided at a location in the longitudinal direction, such that no change of shape at all is permitted in this area in the longitudinal direction of the control element 110, only a bending deformation.

FIGS. 10 to 13 illustrate the interaction of various structural elements with elastic, tubular internal parts of control elements.

Figure 10:
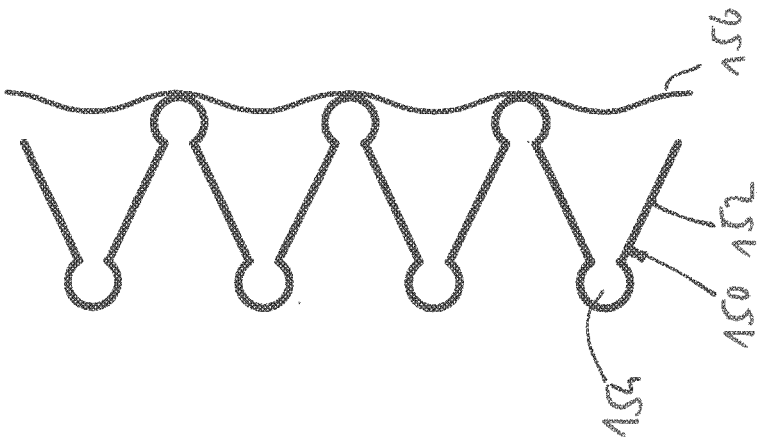

In FIG. 10, a structural element 150 is provided which is produced as a blow-molded part and is composed substantially of rectilinear webs 152 and, lying between these, joint-like portions 154. When the internal part 156 is pressurized and accordingly expands, the structural element 150 stretches, since the webs 152 pivot about the joint-like portions 154.

Figure 11:
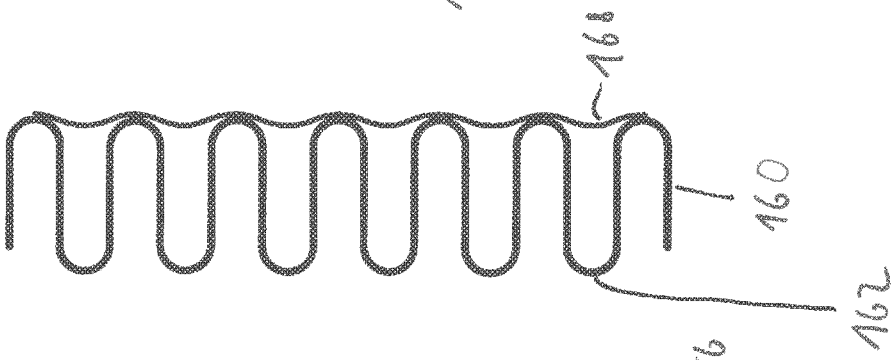

FIG. 11 shows a structural element 160 which has an undulating basic shape, such that, by bending open the joint-like connection sites 162, a change of length is possible upon expansion of an elastic internal part 168.

Figure 12:
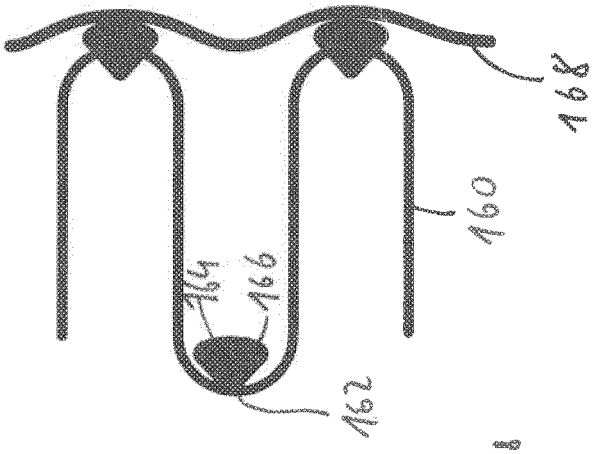

In the embodiment shown in FIG. 12, the structural element 160, which otherwise corresponds to the structural element shown in FIG. 11, is provided, in the area of the joint-like connection sites 162, with substantially tension-resistant elements 164, which further limit the radial deformability of the structural element 160. Moreover, by means of rounded bearing points 166 that cover a large surface area, these tension-resistant elements 164 ensure low-wear contact with the elastic internal part 168.

Figure 13:
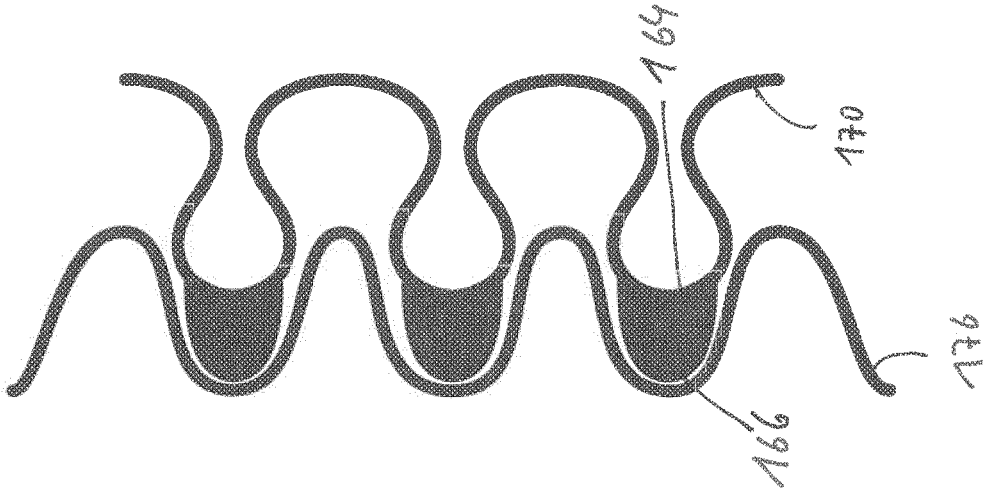
FIGS. 10, 11, 12 and 13 show various embodiments of the elastic areas of a control element according to FIG. 7.

In the embodiment shown in FIG. 13, a structural element 170 is provided which has been produced as a sintered part in an additive production process. The tubular, elastic internal part 176 here has a pre-forming, such that its fold-like structure is adapted to the undulating structure of the sintered structural element 170. Tension-resistant annular elements 164 formed integrally on the sintered part ensure that the position of the elastic internal part 176 with respect to the structural element 170 is maintained also in the non-pressurized state of the internal part 176. The large surfaces 165 of the tension-resistant elements 164 in turn ensure that the elastic internal part 176 is not damaged during the changes of pressure.

Figures 14, 15, 16:
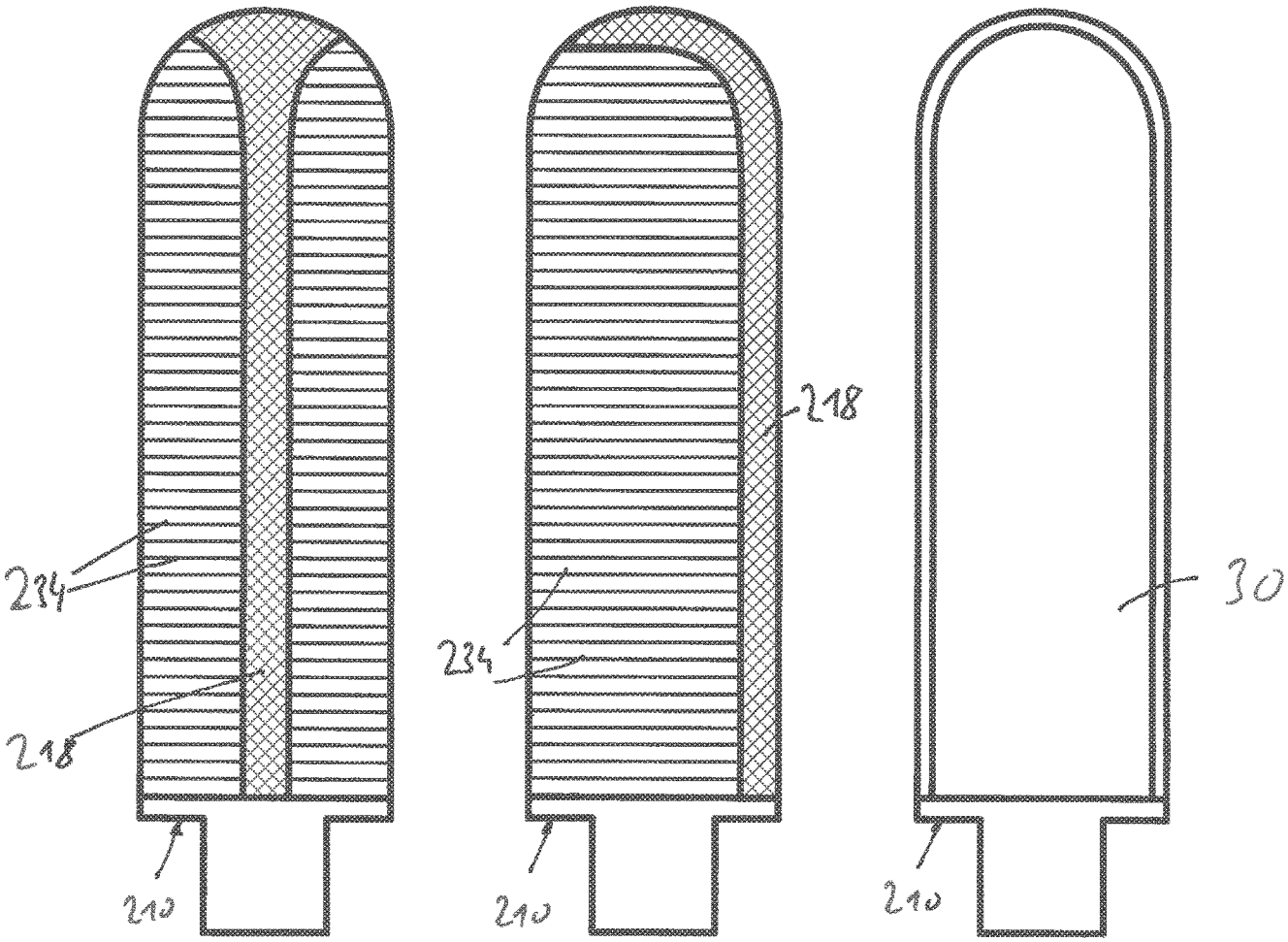
FIGS. 14, 15 and 16 show an embodiment of a finger-shaped control element with a woven structure.

FIGS. 14 to 16 show a further embodiment of a finger-like control element 210 in which, in a wall 224 made of an elastic material which, as in the other embodiments too, can be made of natural rubber, a silicone rubber or another suitable plastic, a structure is embedded which, in the area of a rear face, is designed as a continuous, tension-resistant web 218, and, starting from the web 218, a sequence comprising a large number of annular stiffenings is let into the elastic material, which in turn reduces the radial deformability when pressure is applied. However, on account of the elastic material lying between them, the annular elements 234 are variable in terms of their spacing when pressure is applied, such that a deflected state corresponding to FIG. 6 can again be obtained when pressure is applied and when the tension-resistant web 218 has a flexible configuration.

Figures 17, 18, 19, 20:
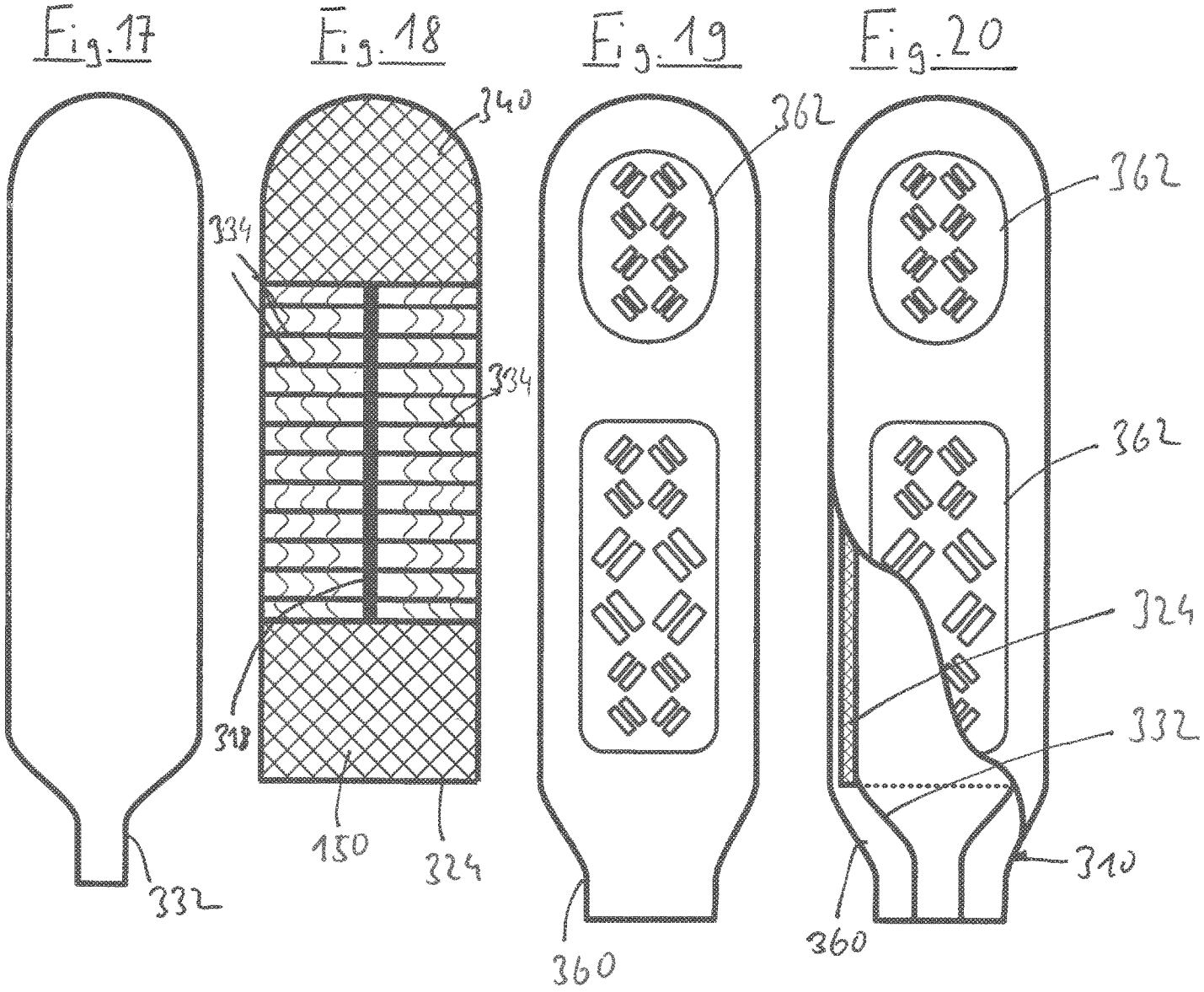
FIGS. 17, 18, 19 and 20 show a further embodiment of a three-part finger-shaped control element.

FIG. 20 shows a partially sectioned view of a further embodiment of a finger-shaped control element 310 which has a multi-layer structure. A tubular elastic internal part (see FIG. 17) is enveloped by a woven structure 324, which is shown in FIG. 18. The woven structure is designed in such a way that the woven fabric is stiff in a head area 340 and in a foot area 350. In a central portion, tension-resistant annular elements 334 are again provided, between which woven threads are arranged which permit a change of length of the structural element 324 of woven fabric in this area. On one side of the control element, a tension-resistant element 318 ensures that no change of length is possible there when pressure is applied to the elastic internal part 332, such that a bending movement similar to FIG. 6 again takes place when pressure is applied. So that the structural element 324 formed as a woven fabric is protected against damage from outside, the control element 310 moreover has an elastic outer sheath 360, which is provided with structured gripping surfaces 362. The gripping surfaces 362 are arranged on that side of the control element 310 on which the tension-resistant element 318 is also located, since the concave curvature according to FIG. 6 is on this side of the control element. The three individual parts of the structural element, namely the elastic internal part 332, the structural element 324 formed as woven fabric, and the elastic outer sheath 360, can be adhesively bonded or welded to each other, although this is not strictly necessary.

Figure 22:
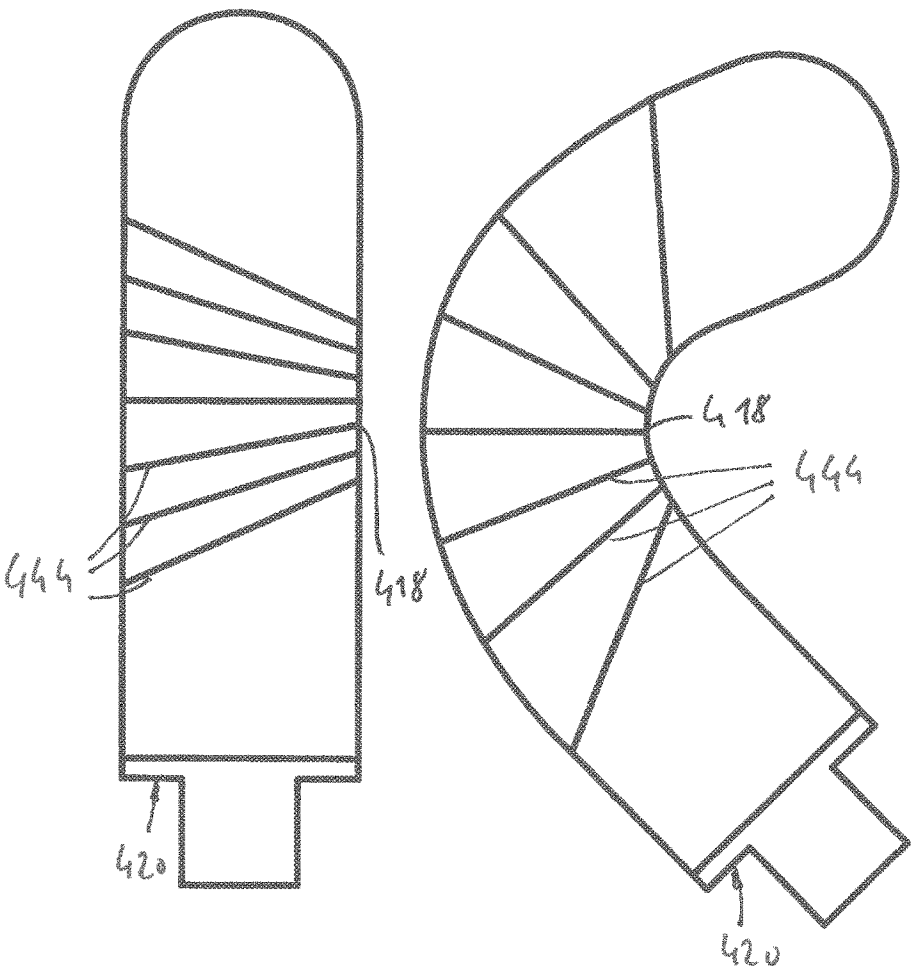
Figure 21:
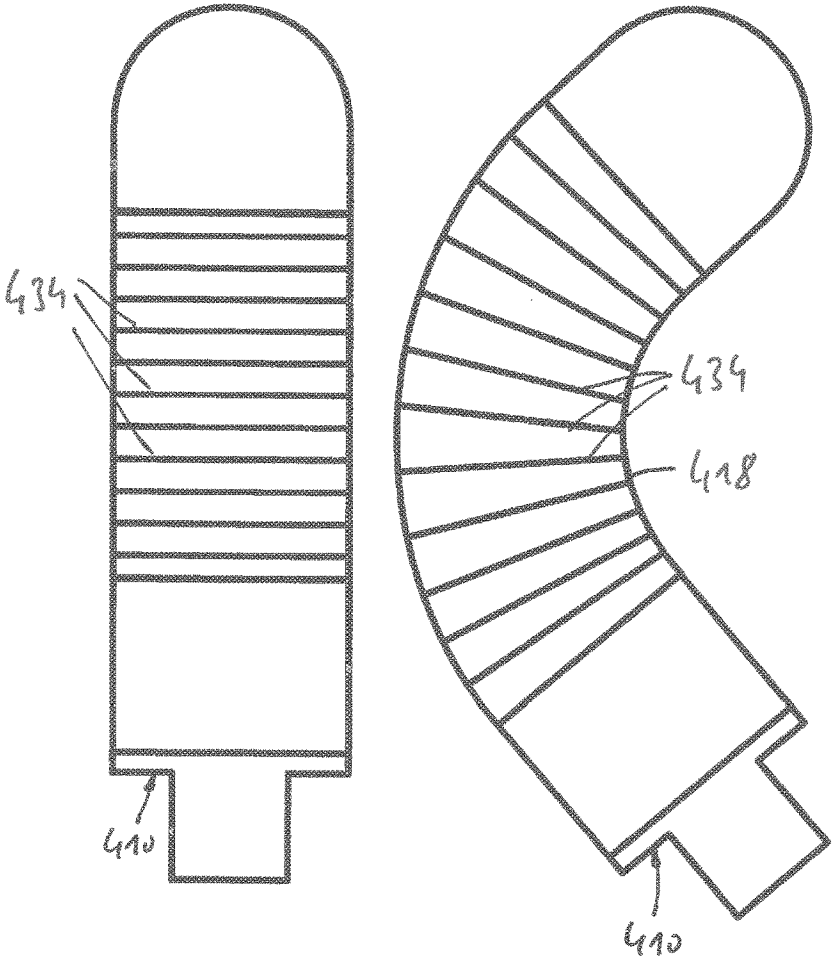
FIGS. 21+22 show diagrammatic side views of two control elements with different bending capacity.

FIGS. 21 and 22 are schematic representations of how a different deflection behavior can be achieved by different configuration of the elastic areas in a finger-shaped control element 410 and 420. Whereas the embodiment of a finger-shaped control element 410 shown in FIG. 21 has tension-resistant annular elements 434 in an elastic area, which are spaced uniformly about the circumference of the control element in the resting state, the annular elements 444 according to the embodiment of a control element 420 according to FIG. 22 have a smaller spacing in the area of a tension-resistant area 418 than on the diametrically opposite side. This configuration reduces the extent of the bending site in the longitudinal direction in the area of the web 418, such that a smaller bending radius is achieved in the control movement, as can be clearly seen by a comparison of the deflected position of the control element 410 according to FIG. 21 and the deflected position of the control element 420 according to FIG. 22.

Figures 23, 24:
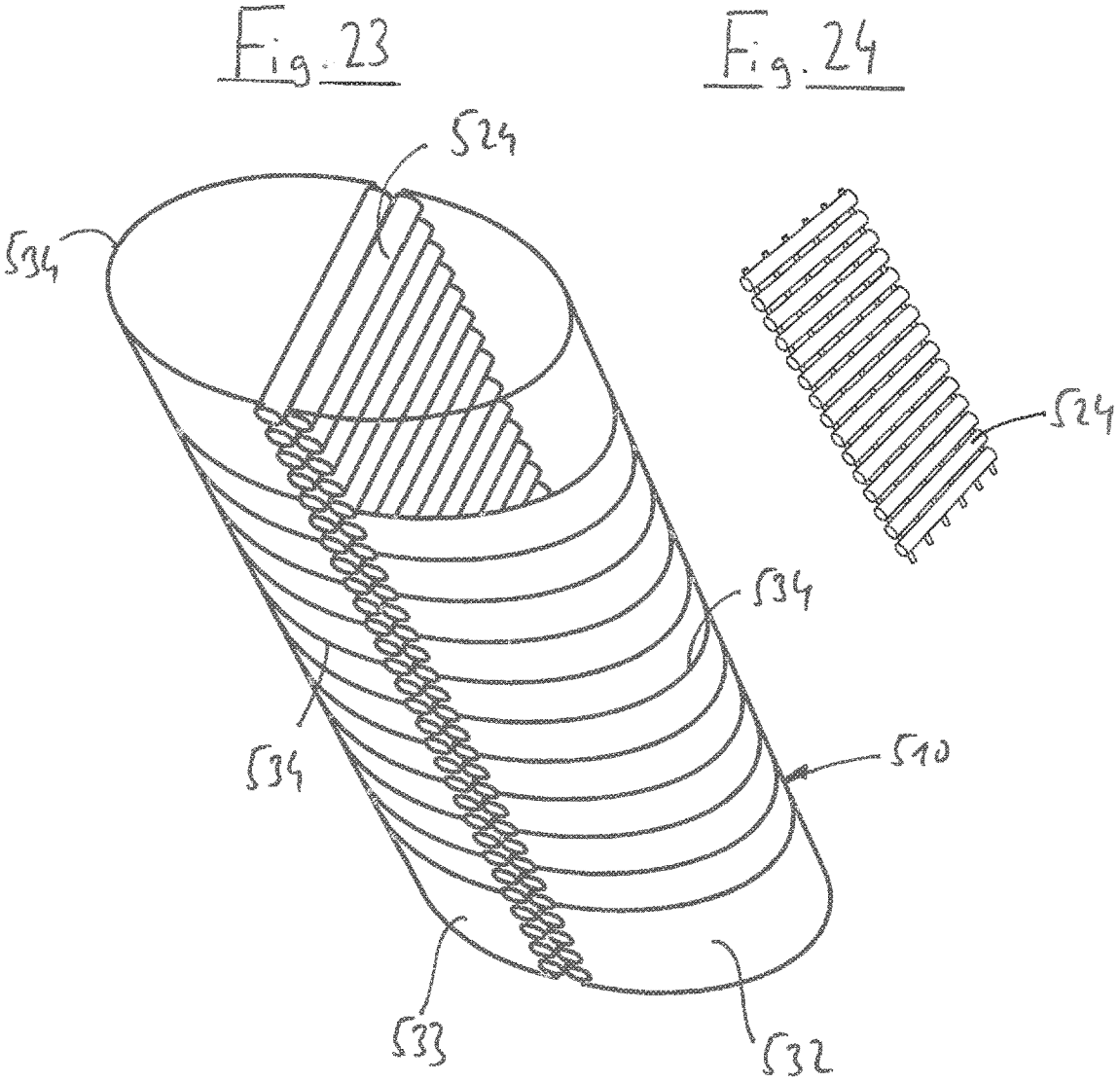
FIG. 23 shows a schematic view of a control element with two internal parts.
FIG. 24 shows a view of an individual part from FIG. 23.

FIG. 23 shows a simplified view of a finger-shaped control element 510 with two internal parts 532, 533, which are separated from each other by a ladder-like structural element 524, wherein semi-annular, tension-resistant elements 534 again limit the radial change of shape of the elastic internal parts 532 in the circumferential direction. The ladder-like structural element 524 permits a bending of the control element 510, depending on which of the two internal parts 532, 533 is subjected to pressure, wherein pressure can optionally also be applied in the opposite direction, i.e. one internal part is subjected to an underpressure, while an overpressure is applied to the other one. With its stiff struts, the structural element 524 prevents one internal part from being able to expand into the volume of the other internal part, which at the least would be very disadvantageous for the deflection capacity of the control element 510.

Figure 25:
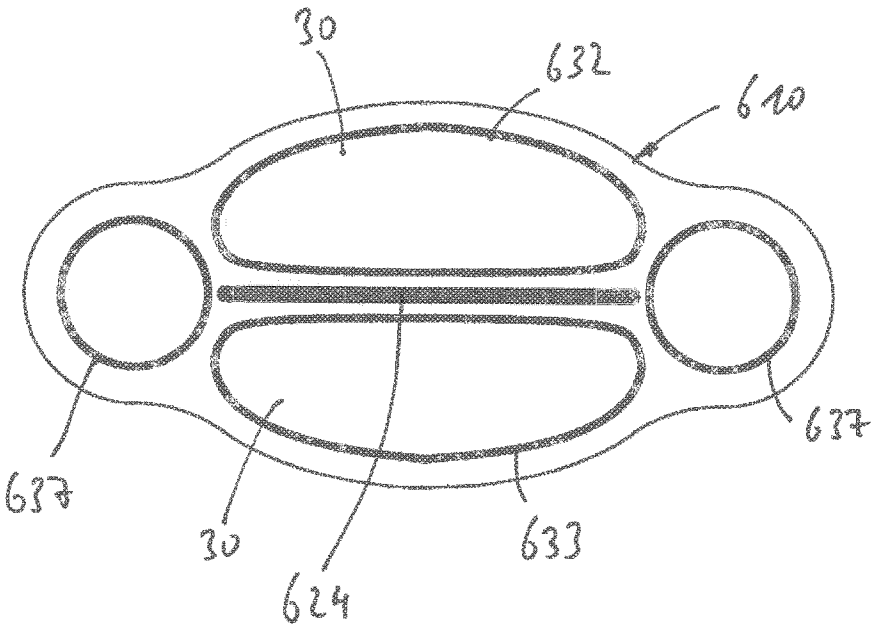
FIG. 25 shows a four-chamber control element in cross section.

FIG. 25 shows a further control element 610 which can be bent in both directions from a straight central position by means of two internal parts 632, 633 and, lying between these, a structural element 624 which permits a bending movement of the control element. Two further internal parts 637 are additionally provided which are likewise designed as elastic tubes and permit a slight correction of the orientation of the control element in a bending direction perpendicular to the main control direction, if this is desired for reasons of precision.

Figure 26:
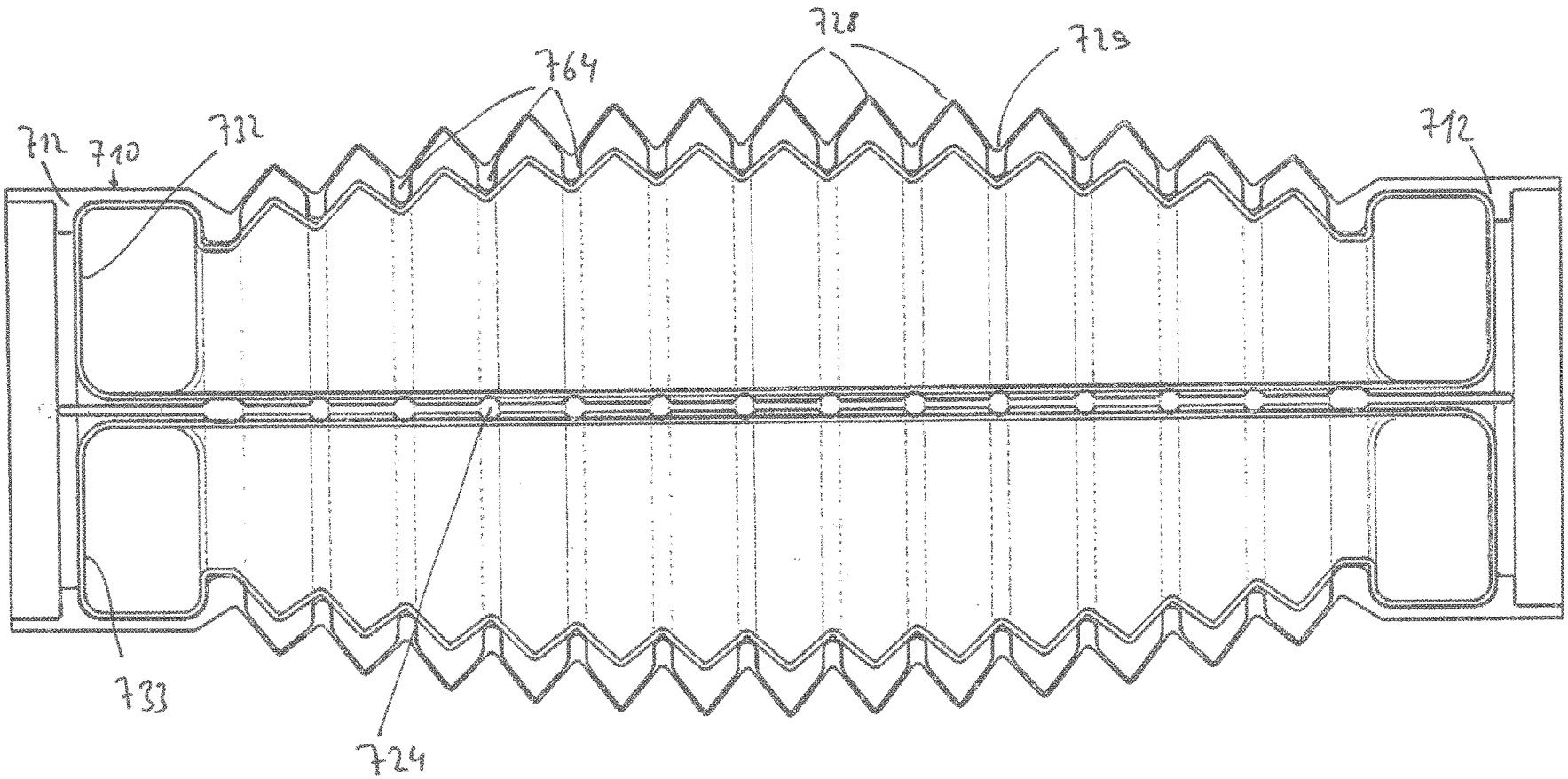
FIG. 26 shows a longitudinal section of an embodiment of a twin-chamber control element.
Figure 27:
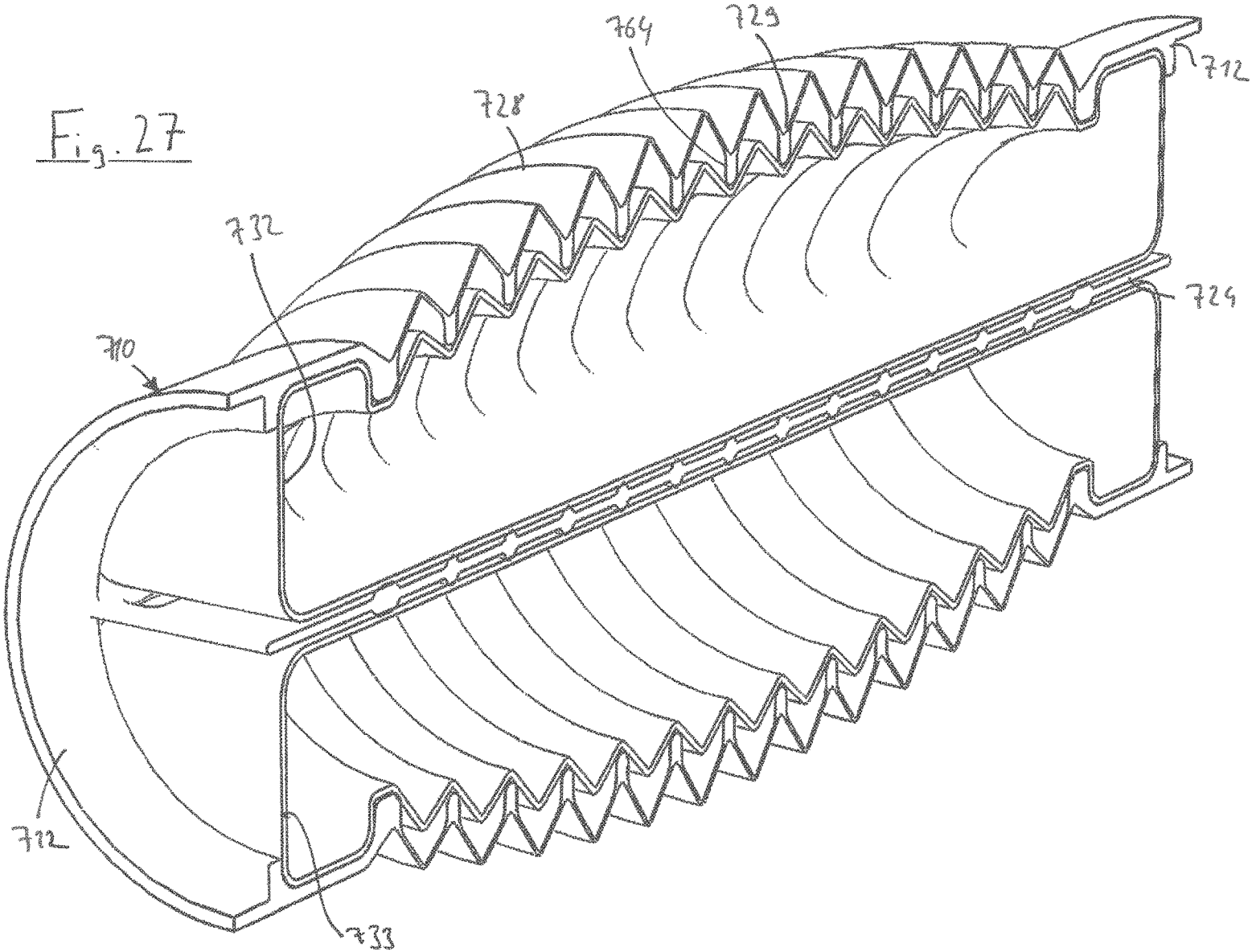
FIG. 27 shows a perspective view of the sectioned control element according to FIG. 26.
Figure 28:
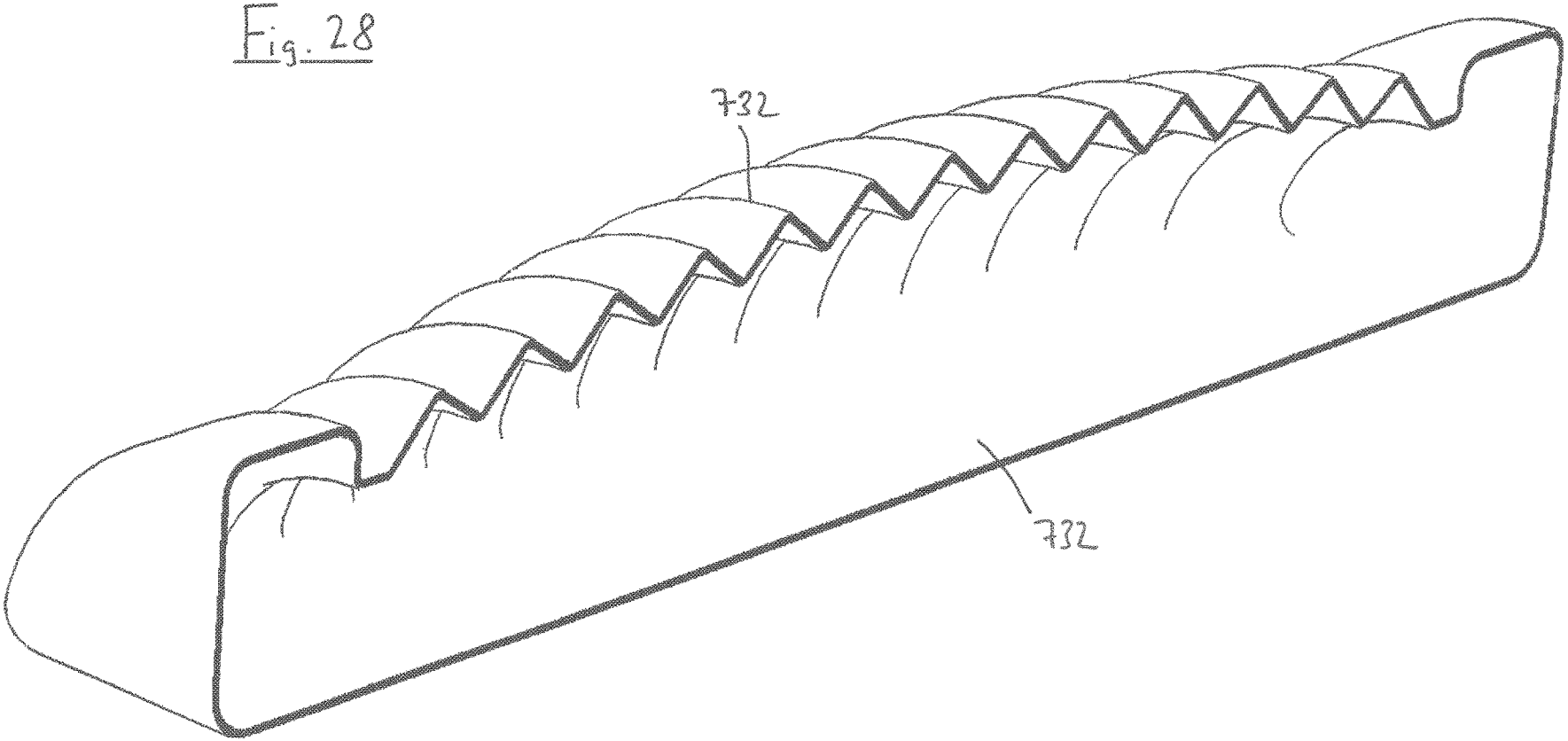
FIG. 28 shows a tubular internal part of the control element according to FIG. 27.

FIGS. 26 to 28 show an embodiment of a control element 710 which follows the principle of the twin-chamber control element 510 shown in FIG. 23. The control element 710 has two elastic internal parts 732, 733 which are separated from each other by a flexurally elastic partition wall 724, which is part of a plastic part sintered in an additive production process and serving as a structural element which at the same time annularly surrounds the elastic internal parts 532, 533 in the manner of a bellows. The bellows structure 728 is configured similarly to the principle shown in FIG. 13, in which tension-resistant annular elements 764 are integrally formed at the inner bending points 729 of the bellows structure 728, which annular elements 764 lie flat on the bellows-like pre-formed outer flanks of the two internal parts 732, 733. In the area of the end faces, the structural element 724 is configured with stiff attachment sites 712, with which the control element 710 can either be bound to a stationary structure or can be combined with other control elements.

Figure 29:
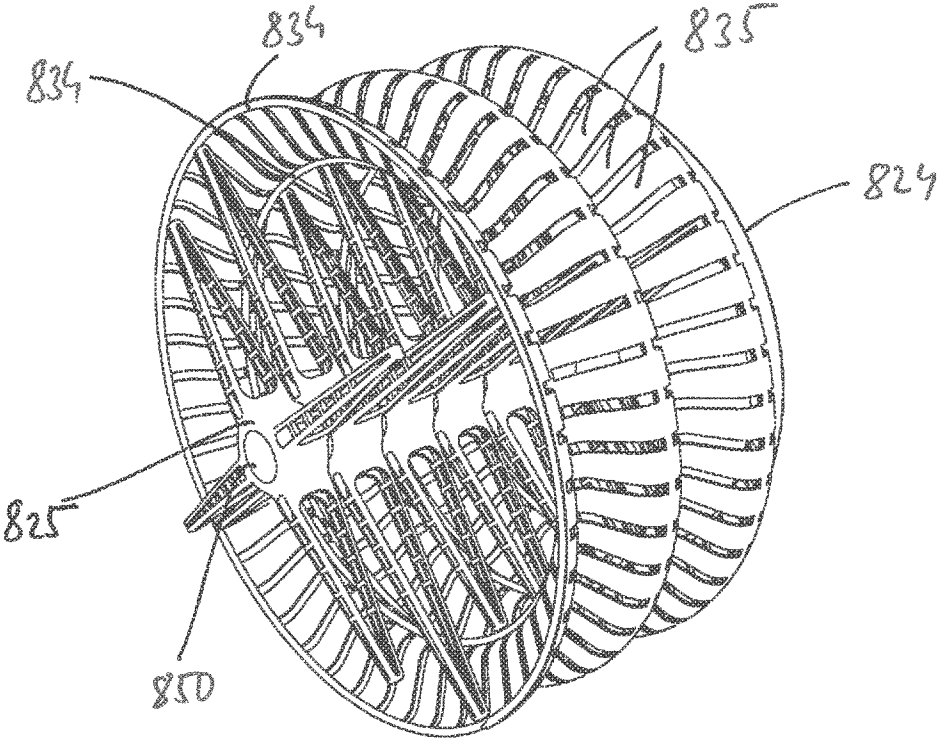
FIG. 29 shows a perspective view of a structural element for a control element.
Figure 30:
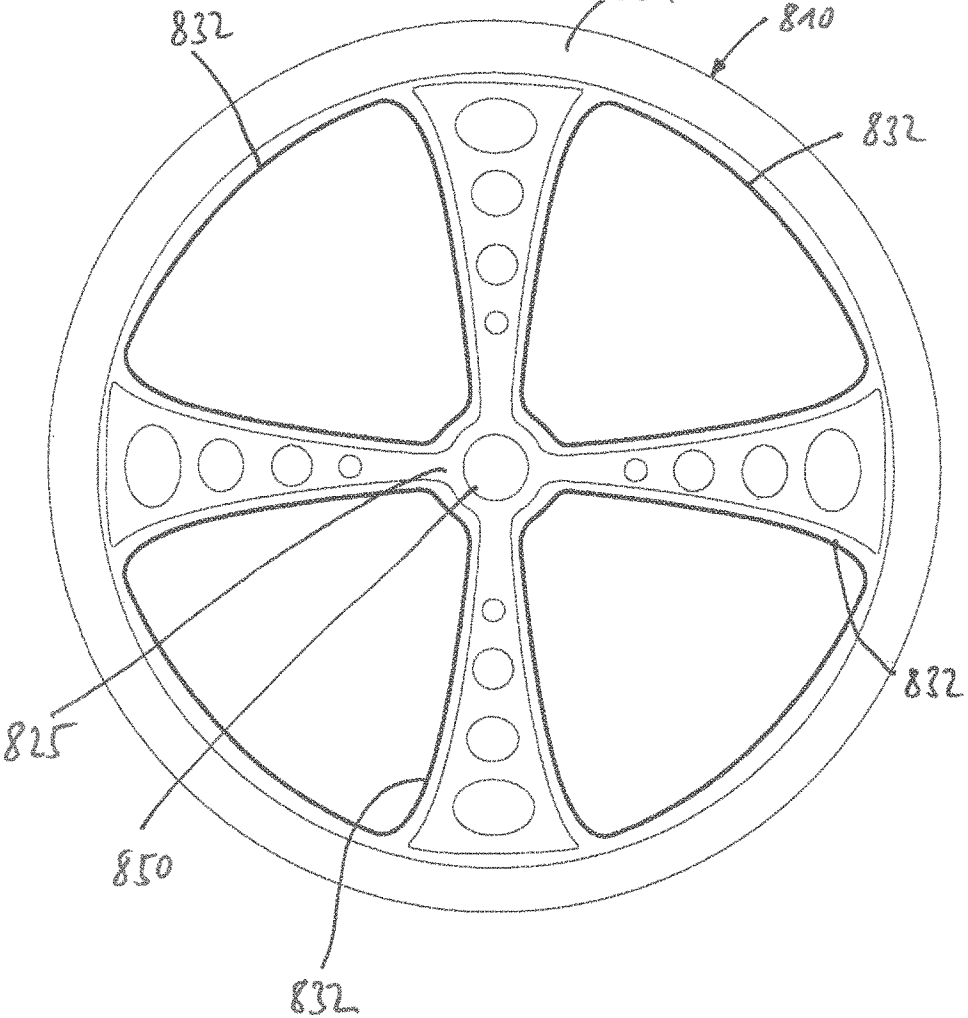
FIG. 30 shows a cross section of a control element with a structural element similar to FIG. 29.

FIG. 29 shows a part of a longer structural element 824, which is provided for a control element with four chambers, i.e. four internal parts 832 (see FIGS. 30 and 31) that can be pressurized independently of each other. The structural element 824 has a structure not unlike a spinal column, with a sequence of several star-shaped support elements 825 which are connected to each other in an articulated manner. Annular elements 834 that are tension-resistant in the circumferential direction are connected to each other by elastic elements 835, such that the structural element 824 can be bent in different directions. A structural element 824 of this kind can be produced from plastic by means of additive production processes.

Figure 31:
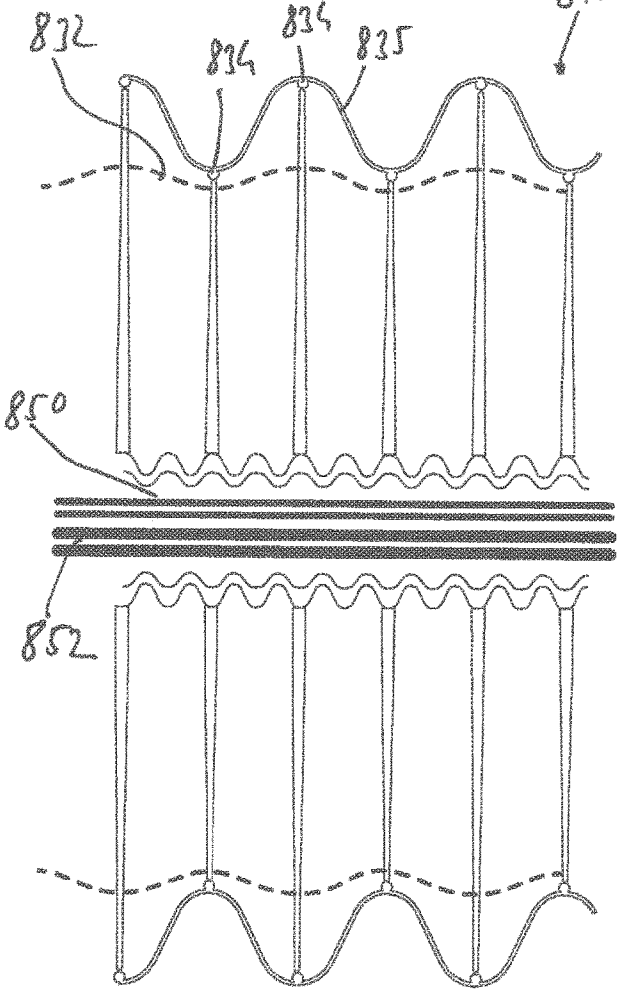
FIG. 31 shows a partial longitudinal section of the control element according to FIG. 30.

As can be seen from FIG. 31, a channel 850 in the central area provides space for supply lines 852, which serve to supply the internal parts 832 or also to supply further control elements that are attached to the control element 810 at the front end. On account of the separate driving of the individual internal parts 832, a change of length takes place zone by zone when the elastic internal part shown in FIG. 31 expands under the effect of pressure and the connection elements 835 are accordingly stretched in this area. The tension-resistant annular elements 834 again prevent an excessive radial expansion, such that the change of volume of the respectively driven internal part 832 can be utilized practically exclusively for the change of shape of the control element 810. A flexible, tension-resistant element which prevents a change of length when pressure is applied can also be arranged in the channel.

Figures 32, 33, 34:
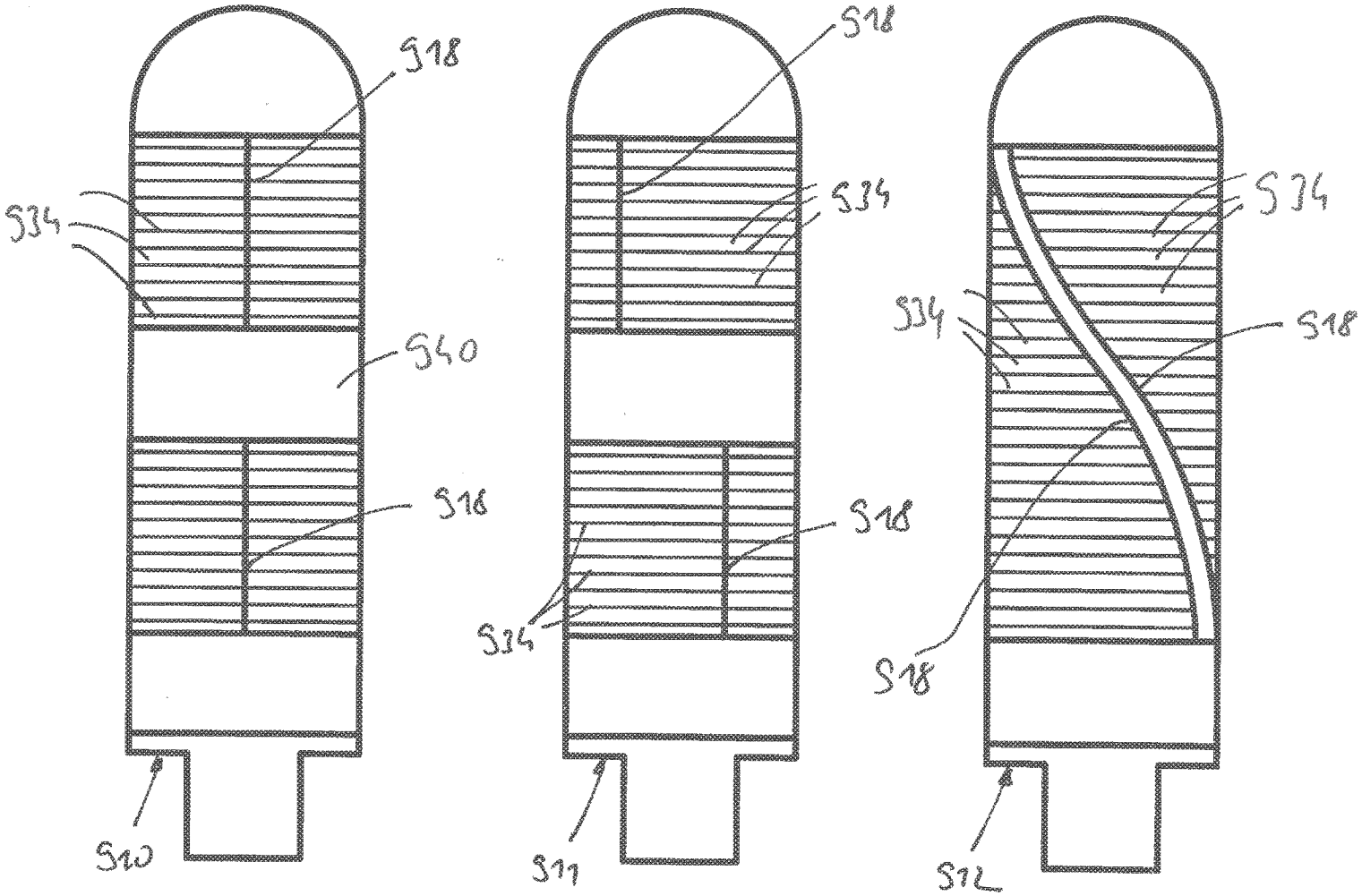
FIGS. 32, 33 and 34 show embodiments of finger-shaped control elements with particular control paths.

FIGS. 32, 33 and 34 show different embodiments of the elastic areas of a control element which lead to a particular deformability of the respective control elements. Lines running in the circumferential direction represent tension-resistant annular elements 934, while the lines extending in the longitudinal direction represent tension-resistant webs 918. Accordingly, the control element 910 shown in FIG. 32 has two bending areas which are spaced apart from each other and are separated from each other by a stiffened portion 940. In the embodiment of a control element 911 shown in FIG. 33, the tension-resistant webs 918 are not aligned, as a consequence of which, when pressure is applied, the elastic area near the head end deforms in a different direction than the elastic area near the lower end of the control element 911.

Finally, the design of an elastic area with a helical web 918, as shown in FIG. 34, permits a torsion control movement of the associated control element 912.

Figure 35:
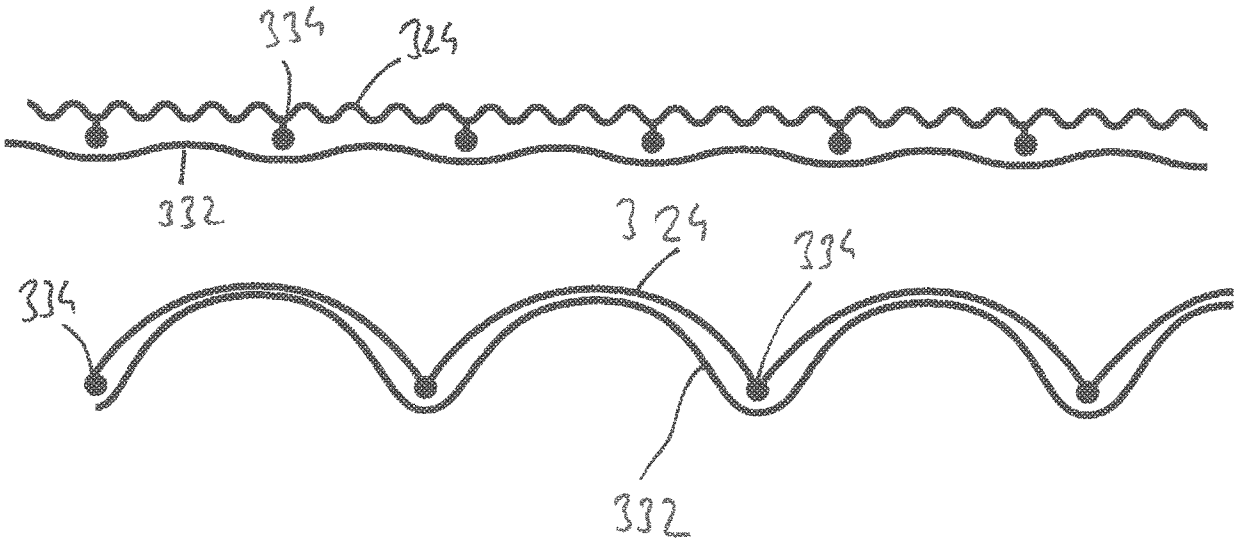
FIG. 35 shows a schematic view illustrating the interaction of an elastic internal part with a woven fabric.

FIG. 35 finally illustrates once again the interaction of an elastic tubular internal part 332 and a woven fabric as structural element 324, which is stiffened by tension-resistant annular elements 334. A corresponding interaction occurs in the control element 310 according to FIGS. 17 to 20.

In the resting state shown at the top in FIG. 35, the woven fabric is relaxed just like the elastic internal part 332, i.e. no internal pressure applies. When pressure increases, the elastic sheath of the internal part 332 expands in such a way that it penetrates between the annular elements 334 and increases the distance between these. The state of the maximum change of length is illustrated in the bottom part of FIG. 35, where the widened internal part 332 lies flat on the knitted structural element 324, i.e. no further change of length is possible in this area. On account of the internal part 332 bulging out between the tension-resistant annular elements 334, it is not possible for the entire volume to be utilized for a change of length of the control element in such an embodiment. However, in the state of maximum stretching, and even before this, the woven fabric in this case already forms a limit on the expansion capacity of the internal part 332, such that the latter cannot expand radially outward in an uncontrolled manner between the tension-resistant annular elements. It is thereby permitted that the expansion of the internal part is concentrated on a change of length that can be utilized for a bending movement or for a change of length of the control element. Here, reference is again made to FIGS. 10, 11, 12 and 13, where the structural elements shown and described there, which can be like bellows, similarly limit the radial deformability of the elastic internal parts, in order to be able to utilize the elasticity specifically for a change of length. This feature of a second level, which avoids bulging of a thin-walled elastic internal part, in order on the one hand to improve the deformability when pressure is applied and on the other hand also to avoid damage of the sometimes sensitive internal part, is also to be found in most of the other embodiments in which a thin-walled internal part and an outer structural element interact.

It should be noted in principle that all of the control elements described here can be operated in principle with a gaseous or a liquid fluid as pressure medium. With a liquid pressure medium in particular, it is possible to reach very high controlling forces or also holding forces, e.g. in a control element as is shown in FIG. 20.

Figure 36:
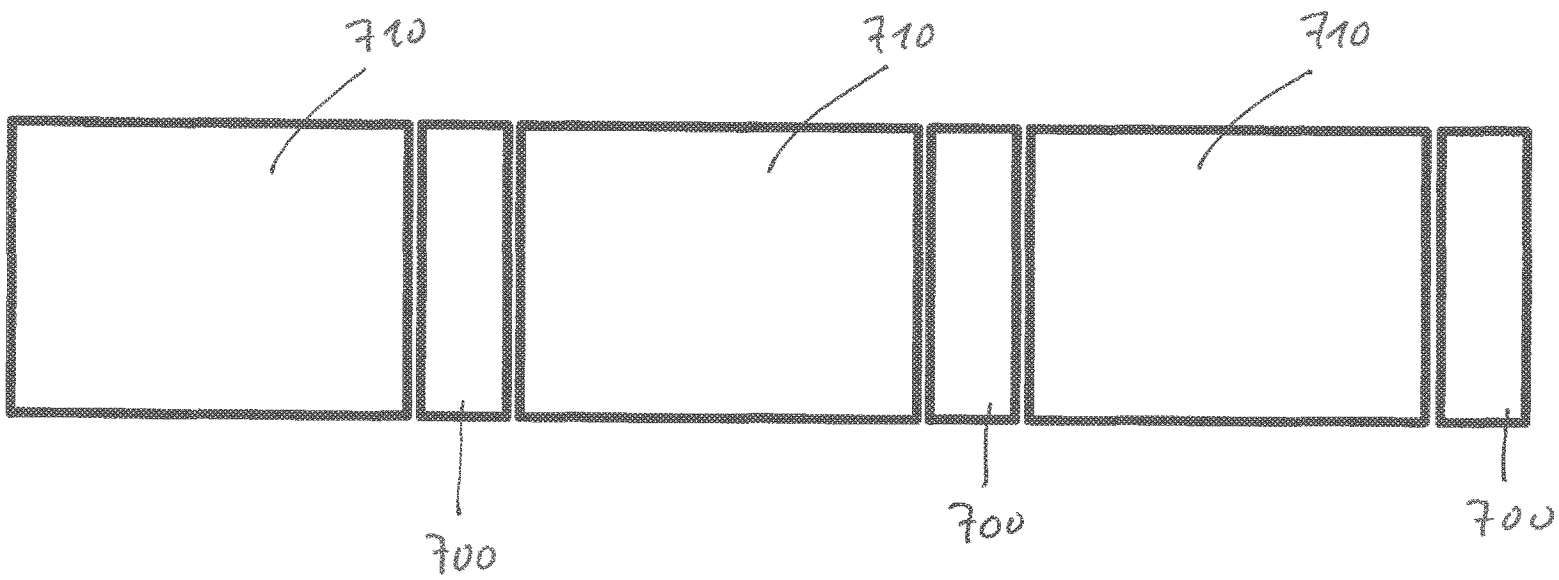
FIG. 36 shows a schematic view of the modular structure of an arm composed of several control elements.

From the control elements shown in FIG. 26, FIG. 30, FIG. 40, FIG. 41 and FIG. 43, having attachment points at both ends, it is possible to create any desired combinations in the manner of a robot arm, such that an arm configured in this way can perform not only changes of length but also desired bending movements. Such a robot arm can be controlled either by strain gauges in the respective elastic areas of the control elements, or also by detection of the position of a certain gripping point or gripping device which is arranged at the free end of the robot arm. For example, FIG. 36 shows such a simple arrangement of control elements 710 with rigid connection elements 700 lying between them, such that overall an arm is obtained which has very flexible mobility depending on a rotation angle arrangement of the control elements with respect to each other.

Figure 37:
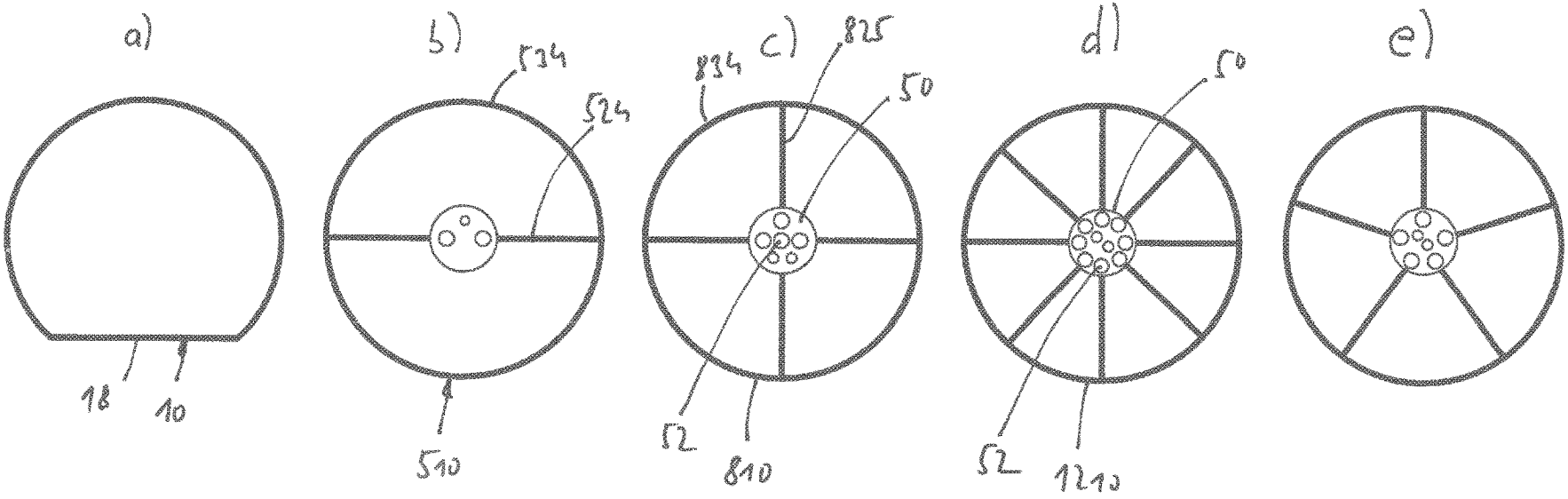
FIGS. 37*a* , 37*b*, 37*c*, 37*d* and 37*e* show control elements with different radial division and a corresponding number of elastic internal parts.

FIG. 37 shows several possible examples of ways in which a control element extending in the longitudinal direction can be subdivided radially into a plurality of chambers which each have an internal part that can be pressurized separately. Whereas FIG. 37*a* shows a cross section of a single-chamber solution, as is realized for example in the control element according to FIG. 1, FIG. 37*b* shows a two-chamber solution according to FIG. 26, which permits a pivotability of the control element in both directions from a rectilinear central position. The extended control possibility according to FIG. 37*c* with four chambers is realized for example in the control element according to FIG. 30, while a solution with eight chambers, as is shown schematically in FIG. 37*d*, is discussed below in connection with FIGS. 43 and 44. Asymmetrical subdivisions, for example as in FIG. 37*e* with five chambers, are also readily possible.

In the multi-chamber systems, a central channel 52 in each case provides space for supply lines 53, the number of which has to be suitably higher to accord with an increased number of internal parts.

Figure 38:
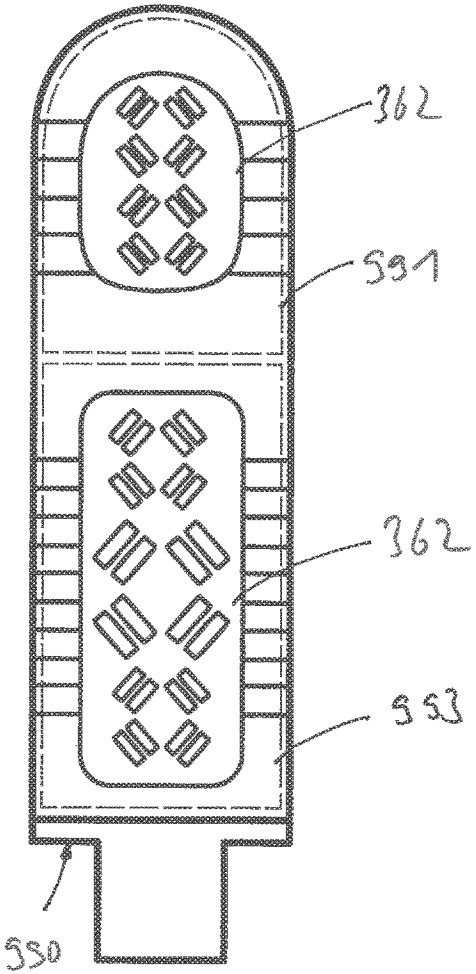
FIG. 38 shows a view of a finger-shaped control element with two separately drivable gripping zones.

FIG. 38 shows a view of a finger-shaped control element 990, which has grip surfaces 362 corresponding to the control element 310 shown in FIG. 20, while two separated internal parts 991, 993 lying axially one behind the other are provided on the inside and can be driven separately from each other. This results in an extended controllability of the movement of the corresponding control element 990.

FIGS. 39 and 40 and FIGS. 41 and 42 show two illustrative embodiments of control elements 1010, 1110 in which a purely axial control movement is provided. The particular aspect of these two control elements 1010, 1110 is moreover that internal parts 1032, 1033 are provided acting in opposite directions, such that the control path is increased. In the embodiment shown in FIGS. 39 and 40, a first internal part 1032 is provided centrally and extends cylindrically between two rigid attachment parts 1012. The first internal part 1032 is enclosed by a second internal part 1033 which is shaped as a hollow ring and which, on its outer faces, has a bellows structure similar to FIG. 13, which will not be discussed in any more detail here.

Figure 39:
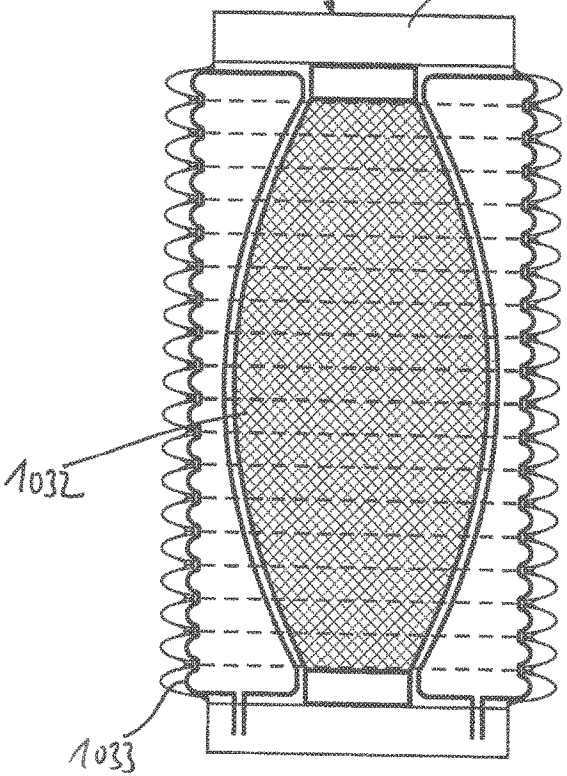
FIG. 39 shows a longitudinal section of a length-variable control element in the compressed state.

In the state of maximum compression of the control element 1010 as shown in FIG. 39, the inner first internal part 1032 is pressurized, while the second internal part 1033 is without pressure. By means of the widening of the first internal part 1032 in the circumferential direction, the two attachment flanges 1012 are moved in a direction toward each other.

Figure 40:
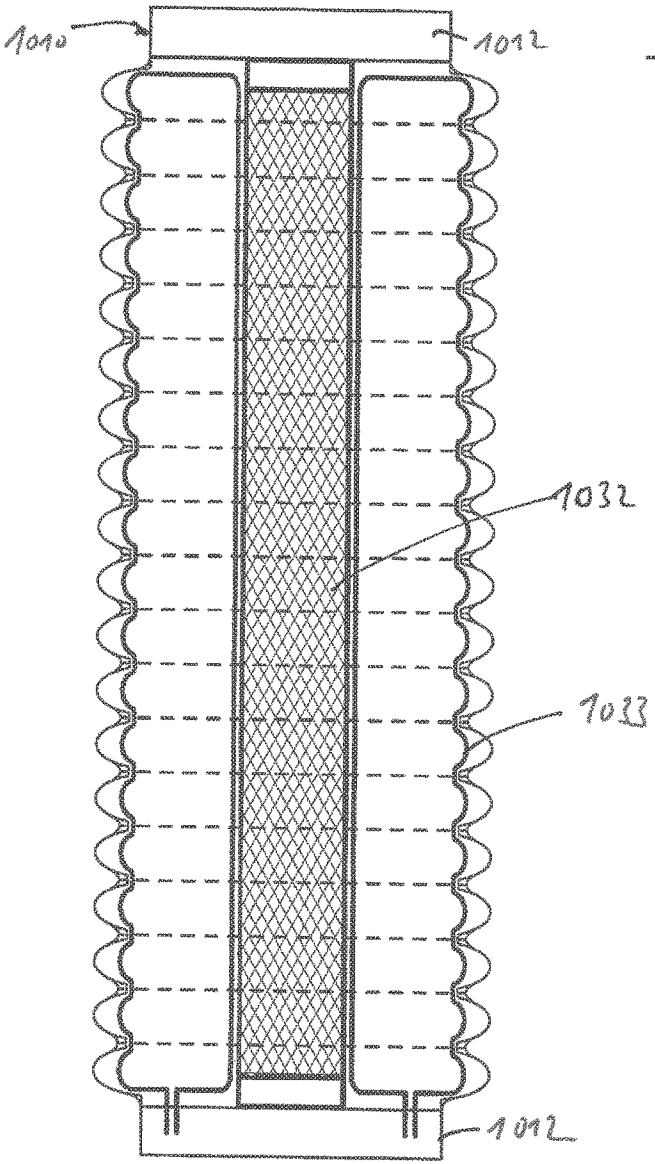
FIG. 40 shows a longitudinal section of the control element according to FIG. 39 in the extended state.

To be able to execute an axial control movement, the first internal part 1032 is now relieved of pressure, while the outer internal part 1033 is subjected to pressure. In this way, the control element 1010 reaches the position of maximum deflection as shown in FIG. 40, wherein guide elements can furthermore be provided between the two attachment flanges 1012 and permit axial guiding.

Figure 42:
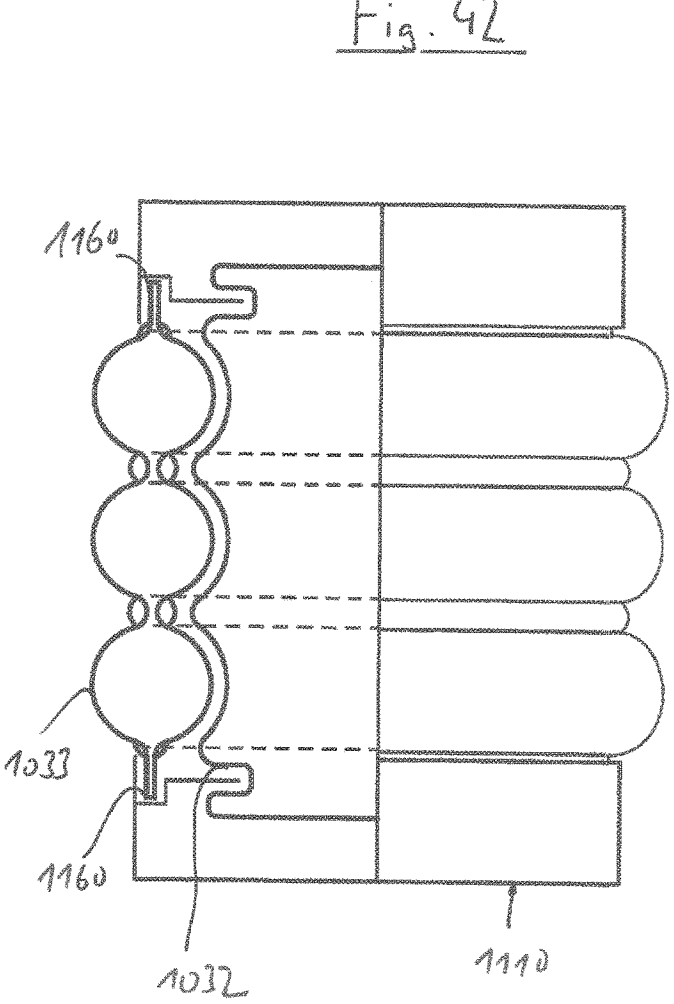
FIG. 42 shows a partially sectioned view of the control element according to FIG. 41 in the compressed state.
Figure 41:
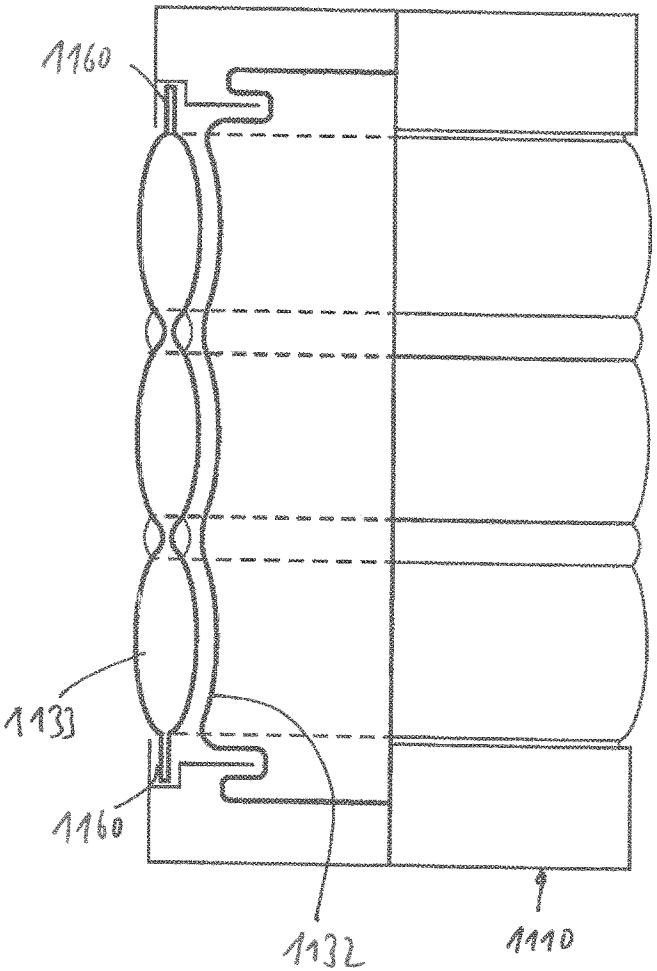
FIG. 41 shows a partially sectioned view of a further embodiment of a length-variable control element in the extended state.

The control element 1110 shown in FIGS. 41 and 42 works according to a similar principle, wherein the internal part 1132 subjected to pressure in the deflected state of the control element is here arranged radially to the inside, while the outer internal part 1133 pressurized for minimizing the deflection annularly surrounds the elastic internal part 1132. However, the principle is ultimately the same, whereby, in the internal part pressurized for compressing the control element 1110, an increase in volume in the radial direction is desired in order to move the front securing points 1160 in a direction toward each other.

Figure 43:
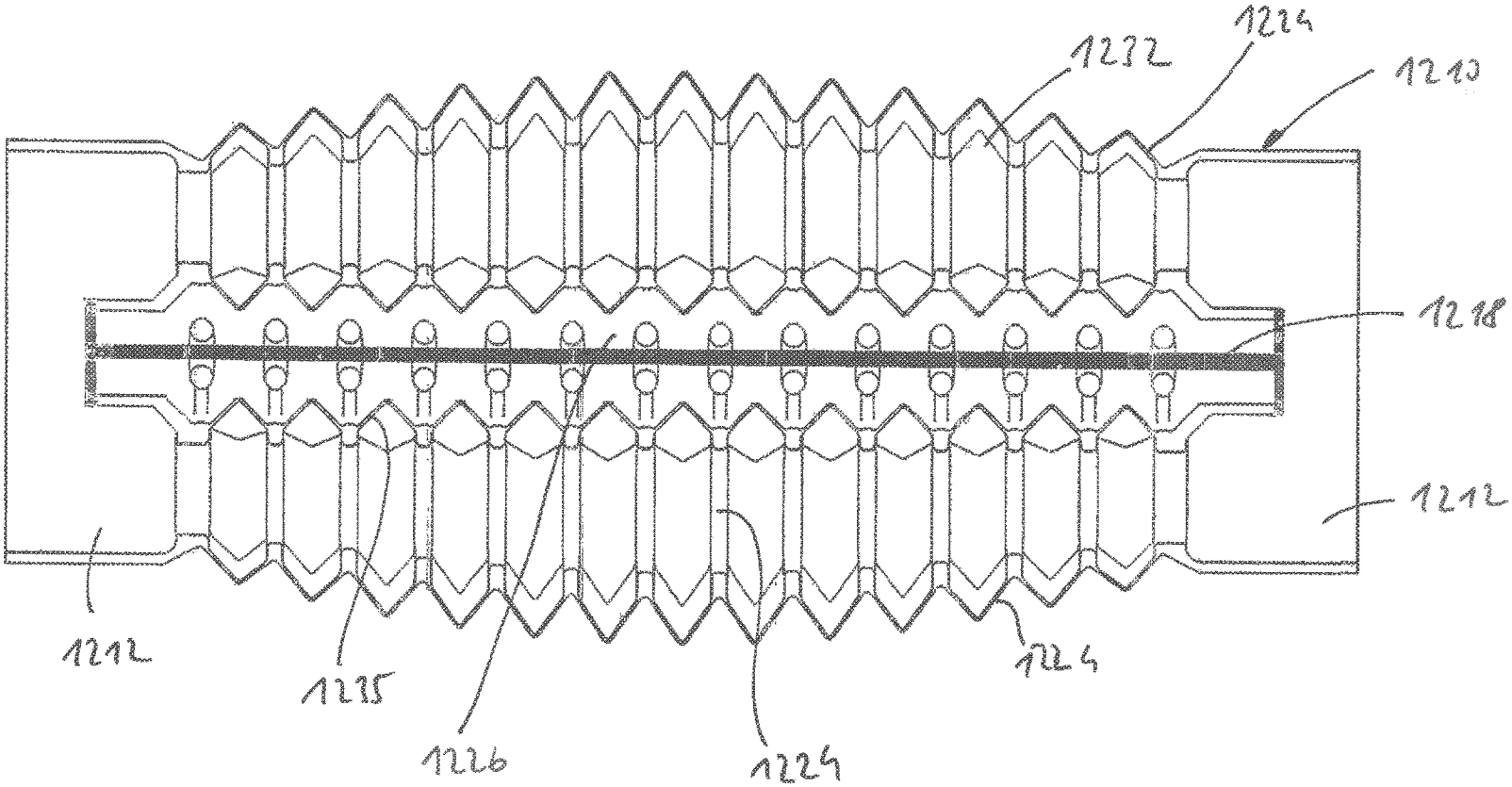
FIG. 43 shows a longitudinal section of a further embodiment of a control element with a radial division according to FIG. 37*d;*
Figure 44:
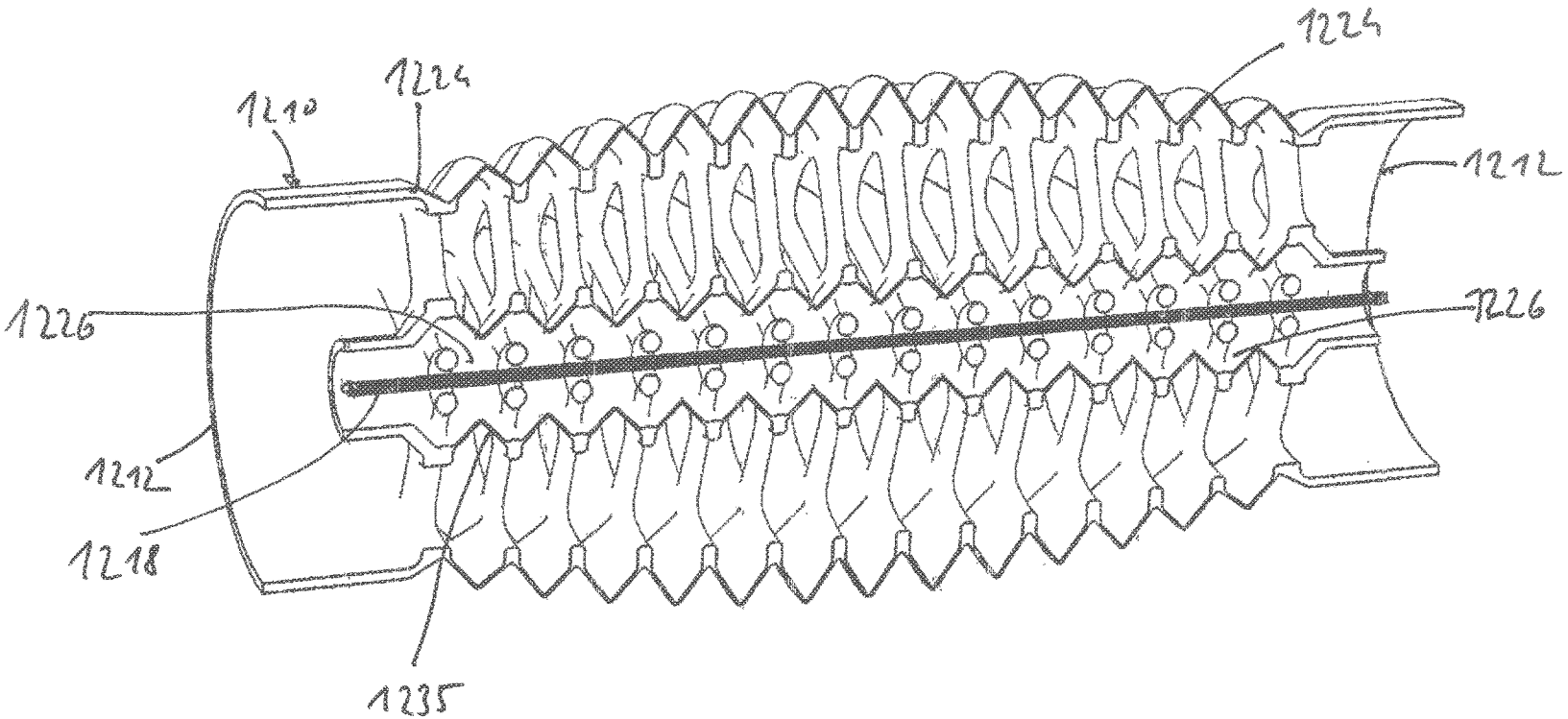
FIG. 44 shows a perspective sectioned view of the structural element of the control element according to FIG. 43.

FIGS. 43 and 44, finally, show a further control element 1210 in which once again a complex structural element 1224 is provided which is produced as a plastic internal part in an additive production process and which provides a radial subdivision according to FIG. 37*d* with eight internal parts 1232 that can be pressurized independently of each other. The outer structure is in turn designed like a bellows, similarly to FIG. 30. With the aid of the eight chambers, it is possible to achieve a particularly fine adjustment of certain positions of the control element 1210. The structure, movable in the area of the individual star-shaped support elements 1225 by elastic coupling points 1226, is here stiffened by a tension-resistant element 1218, which can be designed for example as a wire or carbon-fiber cable. With the aid of the attachment flanges 1212, the control element 1210 can be combined with other control elements in the manner shown schematically in FIG. 36. Reference is again made here to the possibility of deliberately changing the spacing between the attachment points 1212, for example with the aid of an electrical drive, in order to permit a targeted change of length of the control element 1210 when the internal parts 1232 are pressurized, which is permitted by the elasticity in the area of the coupling points 1226. Thus, in a control element 1210 according to FIG. 43, the functionality of a length-variable control element, as is shown in FIG. 39 for example, can be combined with the variability of a control element that is adjustable in all bending directions.

In the embodiment shown in FIGS. 43 and 44, it will also be seen that the expansion capacity of the eight tubular, elastic internal parts 1232 arranged annularly around the center is also limited on the inside by a bellows structure 1235, which prevents one of the thin-walled internal parts 1235, which is pressurized, from being able to expand radially inward in an uncontrolled manner. The bellows structure 1235 is an integral component part of the structural element 1224.

Figure 46:
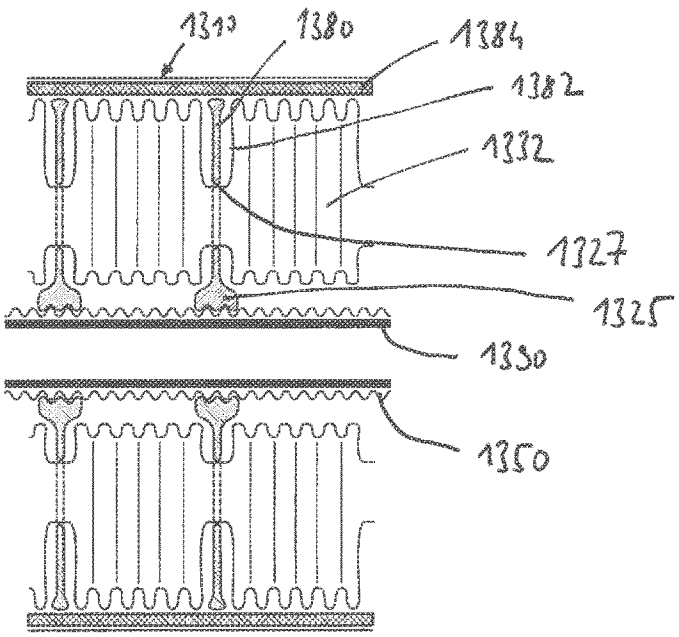
FIG. 46 shows a partial longitudinal section of the control element according to FIG. 45.
Figure 45:
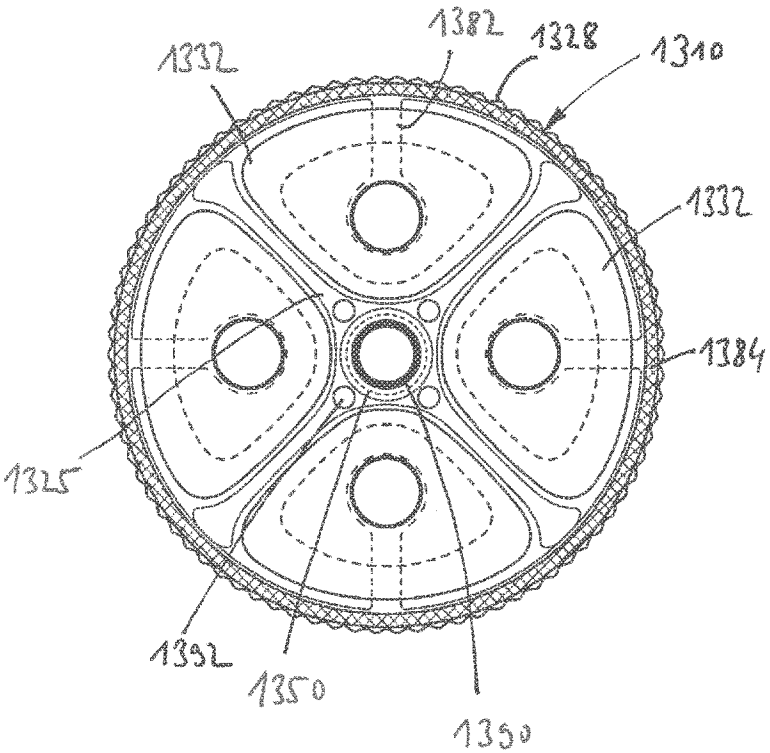
FIG. 45 shows a cross section of a further embodiment of a control element with four internal parts distributed about the circumference.

FIGS. 45 and 46 show a control element 1310 whose outer sheath 1328 is composed of a woven fabric which is extensible in the longitudinal direction and tension-resistant in the transverse direction. The woven fabric also forms the end abutments by limiting the deflection when the threads are stretched to the maximum in the longitudinal direction of the control element.

The control element 1310 has four internal parts 1332 which are distributed uniformly about the circumference and which can be pressurized independently of each other. The internal parts also designed here in the manner of tires are stabilized in the longitudinal direction by a structural element 1324 which is composed of a central corrugated tube 1350 and of star-shaped support elements 1325 arranged thereon at certain intervals. The four internal parts, which are themselves designed as bellows-like PU blow-molded parts or as rubber bellows, sit between the four frames of these support elements 1325. Chambers of the internal parts are connected to each other by pressurized fluid connections in the area of stiff partition walls 1380 of the support elements 1325, wherein separate internal parts can also be provided between the support elements 1325 and are connected to each other by pressurized fluid couplings. The internal parts 1332 have incisions 1382 in order to be able to better mount them on the support elements 1325. An elastomer layer 1384 is provided between the internal parts 1332 and the outer sheath 1328, which elastomer layer 1384 has a damping action and protects the internal parts 1332 from direct contact with the woven fabric of the outer sheath 1328.

The corrugated tube 1350 is provided on the inside with a shape sensor 1390, which detects the movements of the control element. Additional channels 1392 near the center in the support elements 1325 can be used for the feedthrough of electrical lines.

Figure 48:
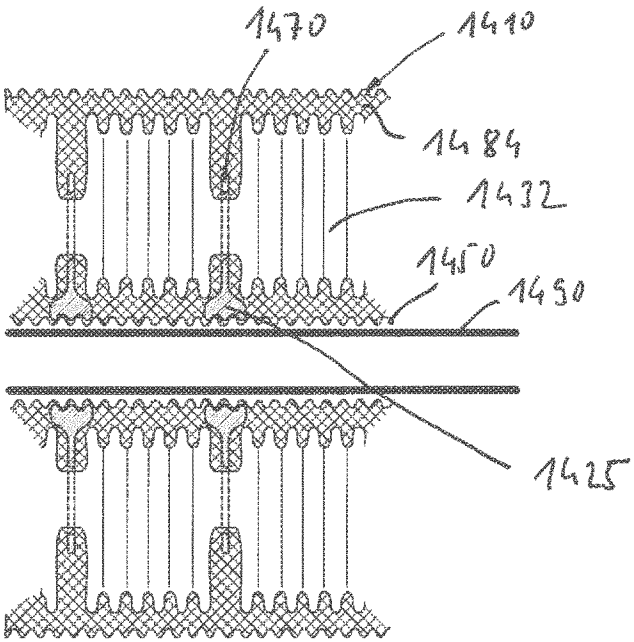
FIG. 48 shows a partial longitudinal section of the control element according to FIG. 47.
Figure 47:
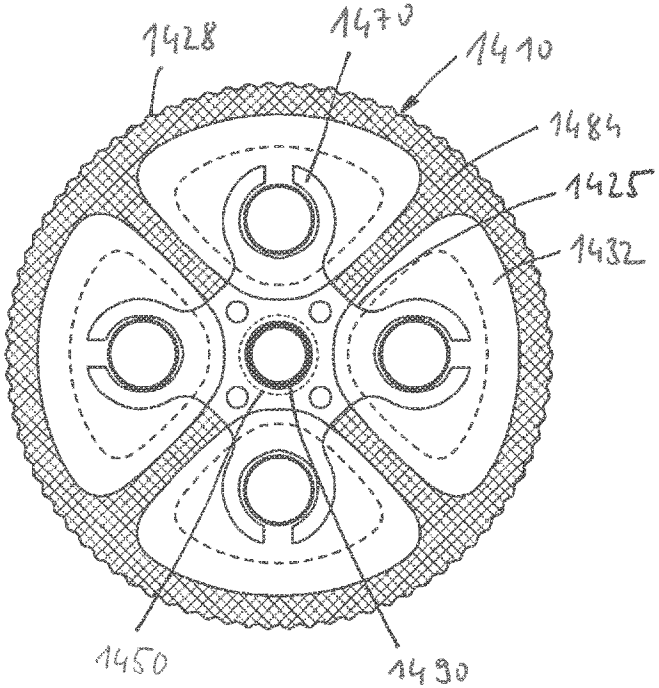
FIG. 47 shows a further embodiment of a control element with four internal parts distributed about the circumference.

FIGS. 47 and 48 show a control element 1410 whose outer sheath 1428 is again composed of a woven fabric which is elastic in the longitudinal direction and tension-resistant in the transverse direction. In this control element 1410 also, four internal parts 1432 are again provided with are distributed about the circumference and with the aid of which a bending control movement of the control element 1410 is permitted. Here too, a corrugated tube 1450 made of metal or plastic serves in turn as a base for a structural element which is segmented by support elements 1425 mounted on the corrugated tube 1450. In this embodiment, clip-like holding elements 1470 of the support elements engage around the connection channels 1427 between the chambers succeeding one another in the longitudinal direction of the internal parts 1432. This embodiment also has the particular aspect that free spaces remaining between the outer sheath 1428, the internal parts 1432, the support elements 1425 and the corrugated tube 1450 are filled with a foam material 1484. The latter has a damping action and avoids a frictional contact between the individual elements. The filling of free spaces with foam, or the insertion of shaped foam parts into these free spaces, can also be applied to all the other embodiments presented here.

Here, the corrugated tube 1450 also in turn receives a shape sensor 1490.

Figure 50:
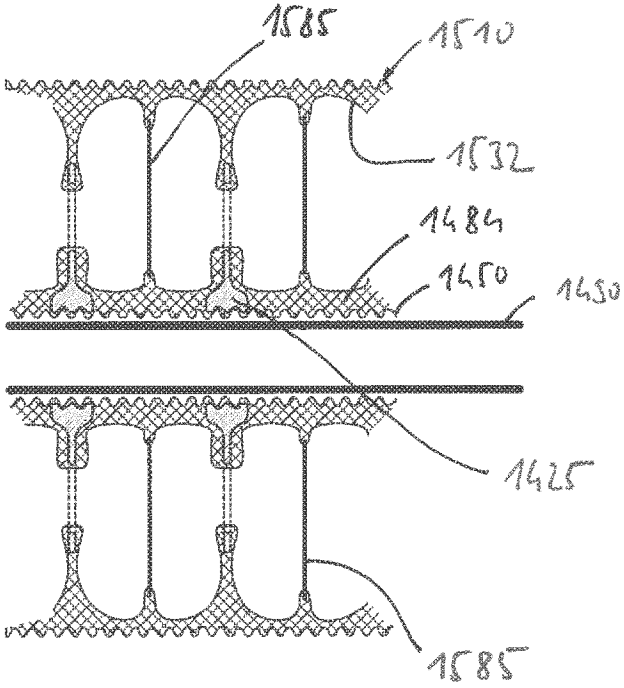
FIG. 50 shows a partial longitudinal section of the control element according to FIG. 49.
Figure 49:
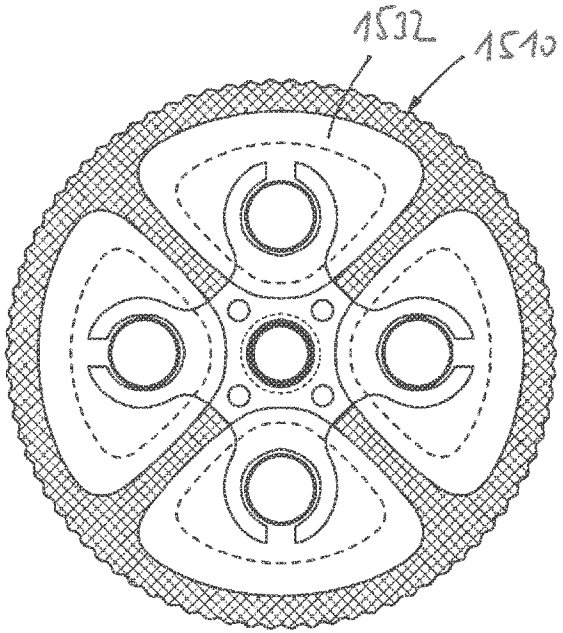
FIG. 49 shows a further embodiment of a control element with four internal parts distributed about the circumference.

FIGS. 49 and 50 show an embodiment of a control element 1510 which corresponds substantially to the control element 1410 according to FIGS. 47 and 48. By contrast, however, the internal parts 1532 are less like bellows and are provided centrally with annular anchors 1585, which limit a radial change of shape of the internal parts 1532 when pressurized. However, corresponding annular anchors can also be used in the previously described control element 1410 in the area of the bellows structure of the internal parts 1432 provided there.

Figure 51:
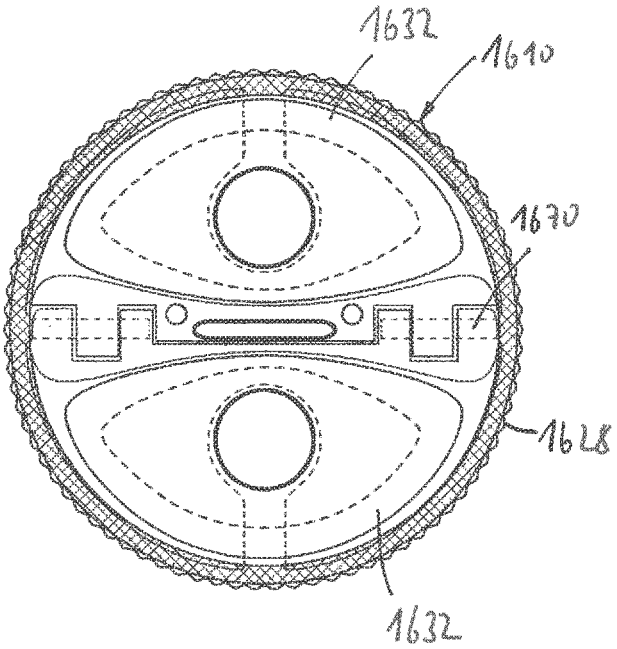
FIG. 51 shows a cross section of an embodiment of a control element with two internal parts acting in opposite directions.
Figure 52:
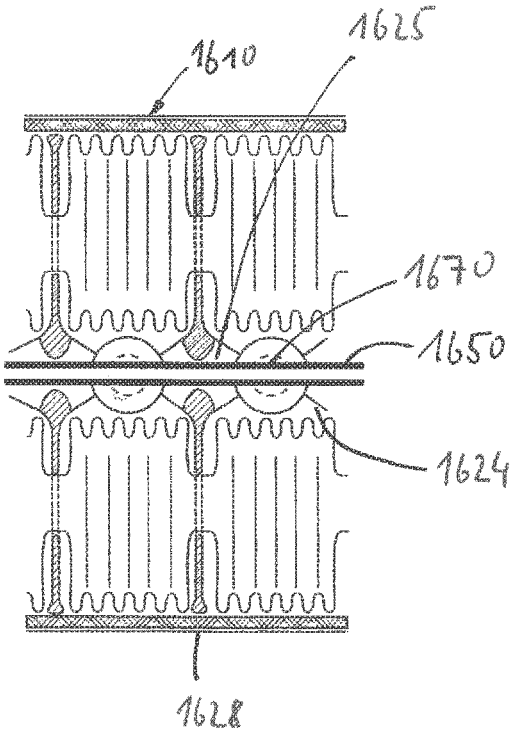
FIG. 52 shows a partial longitudinal section of the control element according to FIG. 51.

FIGS. 51 and 52 show a control element 1610 which has only one degree of freedom for a bending movement in one plane. For this purpose only two opposite internal parts 1632 are needed, while a structural element 1624 is here formed by support elements 1625, which are connected to each other via joint axles 1670.

A cable channel 1650, which can also receive a shape sensor in a simplified embodiment, has an elongate cross section. The outer sheath 1628 is once again designed to be tension-resistant in the transverse direction and also only has to permit a bending movement in the desired degree of freedom.

Figure 53:
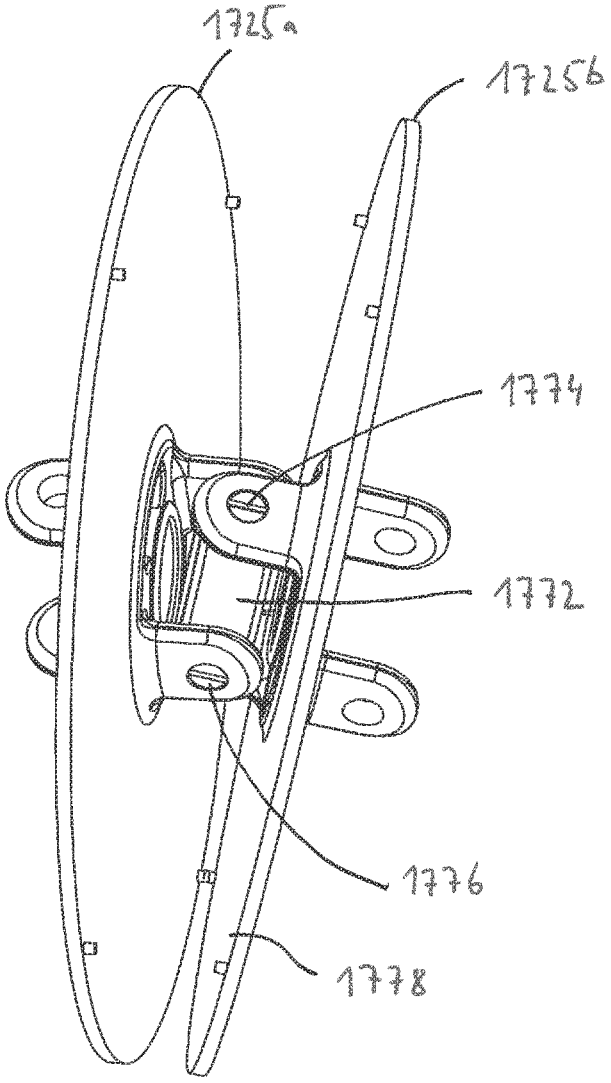
FIG. 53 shows a view of two modules for forming a structural element.

If a bending movement of a control element in space is desired which is defined via joint axles, it is possible, in addition to the already described three or four internal parts distributed about the circumference, also to use support elements 1725 according to FIG. 53, which have a cardan joint connection 1770. An intermediate element 1772 is articulated on a first support element 1725*a* via a first joint axle 1774 and on a second support element 1725*b* via a second joint axle 1776. This kind of articulated connection can then continue between all the support elements 1725 in order to form the structural element, wherein the internal parts act between partition walls 1778 of the support elements.

FIGS. 54 and 55, finally, show schematic views of a further two control elements 1810 and 1910, the basic principle of which can be readily combined with the variants described above. Both control elements 1810, 1910 have in common the fact that the volumes of the internal parts 1832, 1932 decrease away from a clamping point 1800, 1900 of the control element 1810, 1910. This takes account of the fact that, for example in order to lift a load, the force that has to be applied by the internal part is also smaller at a distance from the clamping point, since the moment becomes smaller. This is particularly advantageous if the depicted sequence of internal parts is jointly attached to a common pressure source and, accordingly, there is the same pressure in all of the chambers.

In the control element 1810 according to FIG. 54, the reduction of the volume is achieved by a decreasing external diameter of the chambers of the internal part or of the separate internal parts 1832, whereas, in the control element 1910 according to FIG. 55, the axial extent of the internal parts 1932 decreases while the diameter remains constant.

What is claimed is:

1. A control element with at least one elastic internal part that can be connected, via an attachment, to a pressurized fluid source and/or a vacuum source, which permits pressurization or evacuation of a cavity in the internal part, characterized in that the modulus of elasticity of a wall delimiting the internal part is formed differently in certain sections such that, instead of a homogeneous increase or decrease in volume under pressurization or evacuation, a directed change of shape takes place, between a resting state and a pressurized or evacuated state, that describes a control path of the control element, wherein structural elements form a limit on an expansion capacity of the at least one elastic internal part, such that the at least one elastic internal part, under pressurization, expands only in a desired direction which makes a contribution for the control path, wherein said structural elements increase the modulus of elasticity of the otherwise homogeneously elastic sheath of the expansion element in certain sections of said elastic sheath, such that a desired change of shape takes place under pressurization, and wherein the structural elements are composed of a sequence of mutually articulated members as modules, between which a plurality of the at least one internal parts are arranged.

2. The control element as claimed in claim 1, characterized in that an elastic material of the at least one internal part forms, with a stiffer material of a structural element, a composite as a wall, wherein punctiform, linear or planar connection sites are provided.

3. The control element as claimed in claim 2, characterized in that the structural element is designed as a woven fabric, as a sintered body of plastic or as a plastic layer injected around the respective internal part.

4. The control element as claimed in claim 3, characterized in that certain zones of said woven fabric have a different force-elongation behavior, wherein the woven fabric is coupled to a wall of an elastic expansion element of the control element or is embedded in the wall.

5. The control element as claimed in claim 2, characterized in that tension-resistant elements are worked into the structural element.

6. The control element as claimed in claim 5, characterized in that the tension-resistant elements are designed as cables, bands, rods or woven or latticed structures made of metal or plastic.

7. The control element as claimed in claim 1, characterized in that the wall has one or more stiffened zones engaging annularly around the at least one internal part.

8. The control element as claimed in claim 7, characterized in that the structural element surrounds the at least one internal part completely or like a cage.

9. The control element as claimed in claim 1, characterized in that end abutments are provided which limit the change of shape at a defined pressure level, wherein the position of the end abutments is adjustable.

10. The control element as claimed in claim 1, characterized in that a viscoelastic material for damping oscillations is provided, which is incorporated into the structural element and/or into the internal part.

11. The control element as claimed in claim 1, characterized in that the cavity of the at least one internal part or a free space between at least one of the structural elements and the at least one internal part is filled partially or completely by elastic shaped bodies, wherein the elastic shaped bodies are formed by subsequent foam-filling of the cavities or of the free spaces.

12. The control element as claimed in claim 11, characterized in that the shaped elements have viscoelastic properties.

13. The control element as claimed in claim 1, further comprising a rigid clamping point for securing on a support structure.

14. The control element as claimed in claim 1, further comprising a plurality of structural elements arranged axially behind one another and interconnected internal parts whose cavities are spatially separated from each other, wherein the cavities have separate pressurized fluid attachments, are connected to each other via pressure lines or are coupled to each other via pressurized fluid couplings.

15. The control element as claimed in claim 14, characterized in that rigid clamping surfaces are formed between the internal parts.

16. The control element as claimed in claim 1, characterized in that, in the area of a module, at least two internal parts that can be pressurized separately from each other are arranged about the circumference.

17. The control element as claimed in claim 1, characterized in that joint connections between the members are formed by ball joints, joint axles or elastic coupling points.

18. The control element as claimed in claim 1, characterized in that the volumes, lengths or diameters of the successive internal parts or structural elements are different.

19. The control element as claimed in claim 18, wherein the volumes, lengths, or diameters of the successive internal parts or structural parts increase or decrease continuously.

20. The control element as claimed in claim 1, characterized in that the control element has a tube shape which is subdivided radially and/or circumferentially into a plurality of internal parts whose cavities are separated from each other and which have separate pressure attachments.

21. The control element as claimed in claim 20, characterized in that tension-resistant walls are formed in each case between the internal parts.

22. The control element as claimed in claim 21, characterized in that the tension-resistant walls are incorporated into a member structure which permits a bending of the control element in at least one bending direction.

23. The control element as claimed in claim 1, further comprising stiff areas or areas deformable exclusively in the bending direction, in which areas electrical attachment lines or pressurized fluid lines are arranged.

24. The control element as claimed in claim 1, characterized in that, in deformable wall portions of the internal parts, measurement elements in the form of expansion measurement elements and/or optical measurement elements are provided which detect the change of shape and communicate this to a control system for the pressurization.

25. The control element as claimed in claim 24, characterized in that a conductor foil arranged helically in the longitudinal direction of the control element is provided as measurement element.

26. The control element as claimed in claim 1, further comprising grip surfaces which are formed from a slip-resistant material and/or are formed with a structure.

27. The control element as claimed in claim 1, characterized in that the at least one elastic internal part is surrounded at least in certain sections by a bellows-like structural element which is designed as a corrugated tube made of metal or plastic, as a woven structure, or as a rubber or plastic bellows.

28. The control element as claimed in claim 27, characterized in that only some or all of the folds of the bellows-like structural element directed toward the respective internal part are connected to the internal part or are designed as loose bearing points.

* * * * *